US006144816A

United States Patent [19]

Sasamoto

[11] Patent Number: 6,144,816

[45] Date of Patent: Nov. 7, 2000

[54] METHOD AND SYSTEM FOR SAVING TONER DEVELOPER IN IMAGE DUPLICATING DEVICES

[75] Inventor: Tetsurou Sasamoto, Kanagawa, Japan

[73] Assignee: Ricoh Company, Ltd., Tokyo, Japan

[21] Appl. No.: 09/335,331

[22] Filed: Jun. 17, 1999

[30] Foreign Application Priority Data

| | | | |
|---|---|---|---|
| Jun. 17, 1998 | [JP] | Japan | 10-169733 |
| Jun. 18, 1998 | [JP] | Japan | 10-171106 |
| Jul. 15, 1998 | [JP] | Japan | 10-199921 |
| Jul. 15, 1998 | [JP] | Japan | 10-199973 |
| Jul. 15, 1998 | [JP] | Japan | 10-200235 |

[51] Int. Cl.[7] ..... G03G 15/00

[52] U.S. Cl. ..... 399/45; 399/57

[58] Field of Search ..... 399/45, 53, 57, 399/234, 249, 260, 264

[56] References Cited

U.S. PATENT DOCUMENTS

| | | | |
|---|---|---|---|
| 4,246,867 | 1/1981 | Hudson | 399/269 |
| 4,370,056 | 1/1983 | Hays | 399/269 |
| 5,983,041 | 11/1999 | Otaki et al. . | |

FOREIGN PATENT DOCUMENTS

| | | |
|---|---|---|
| 1-007081 | 1/1989 | Japan . |
| 7-209922 | 8/1995 | Japan . |

*Primary Examiner*—Robert Beatty
*Attorney, Agent, or Firm*—Knoble & Yoshida, LLC

[57] ABSTRACT

Conserving a resource in an image-forming device is accomplished by reducing a wasteful or unused portion in a thin layer of liquid toner developer. Based upon the size of an image-carrying medium, the thin layer of the liquid toner developer is variably formed.

11 Claims, 17 Drawing Sheets

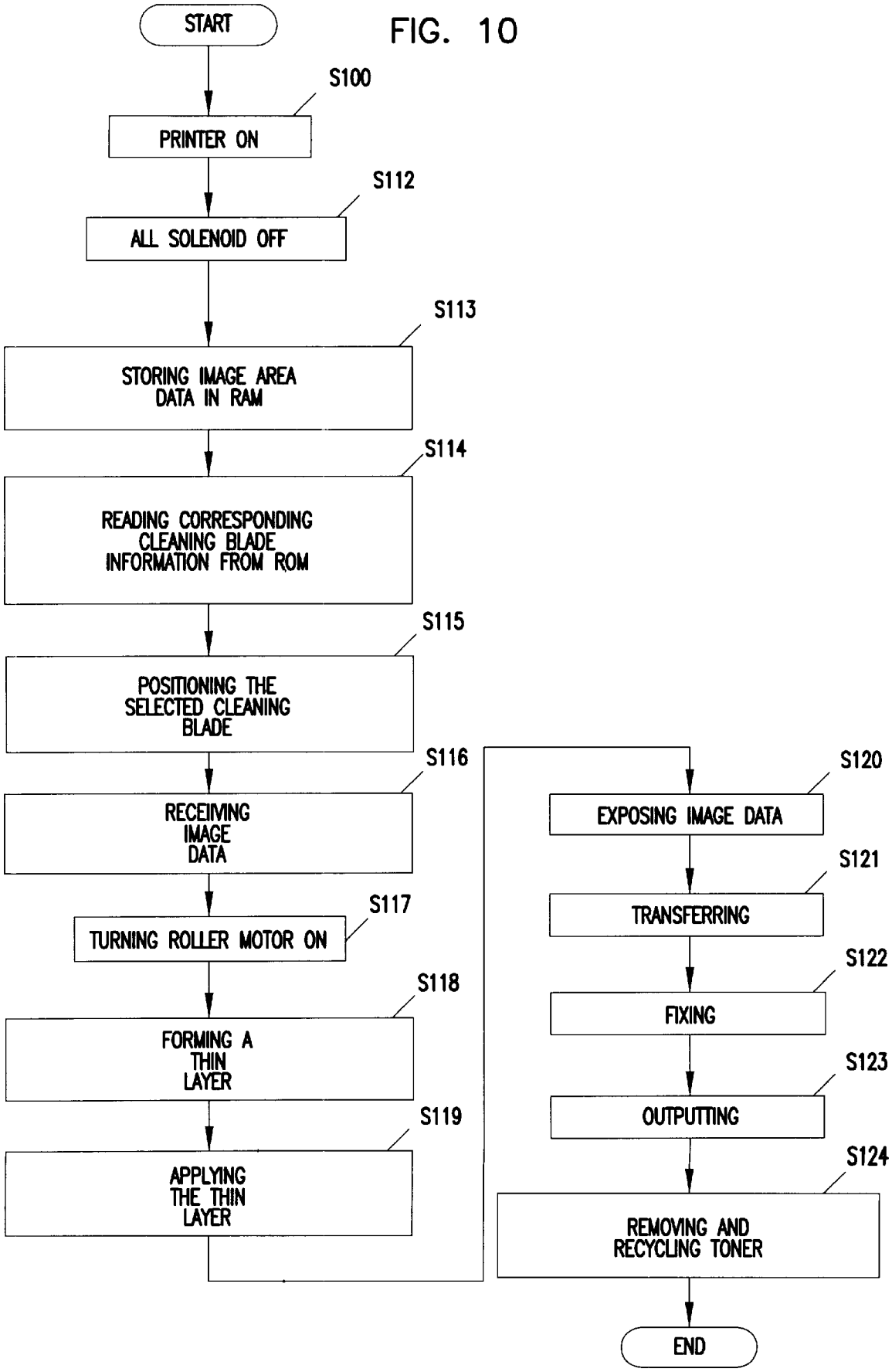
FIG. 10
START
S100
PRINTER ON
S112
ALL SOLENOID OFF
S113
STORING IMAGE AREA DATA IN RAM
S114
READING CORRESPONDING CLEANING BLADE INFORMATION FROM ROM
S115
POSITIONING THE SELECTED CLEANING BLADE
S116
RECEIVING IMAGE DATA
S117
TURNING ROLLER MOTOR ON
S118
FORMING A THIN LAYER
S119
APPLYING THE THIN LAYER
S120
EXPOSING IMAGE DATA
S121
TRANSFERRING
S122
FIXING
S123
OUTPUTTING
S124
REMOVING AND RECYCLING TONER
END

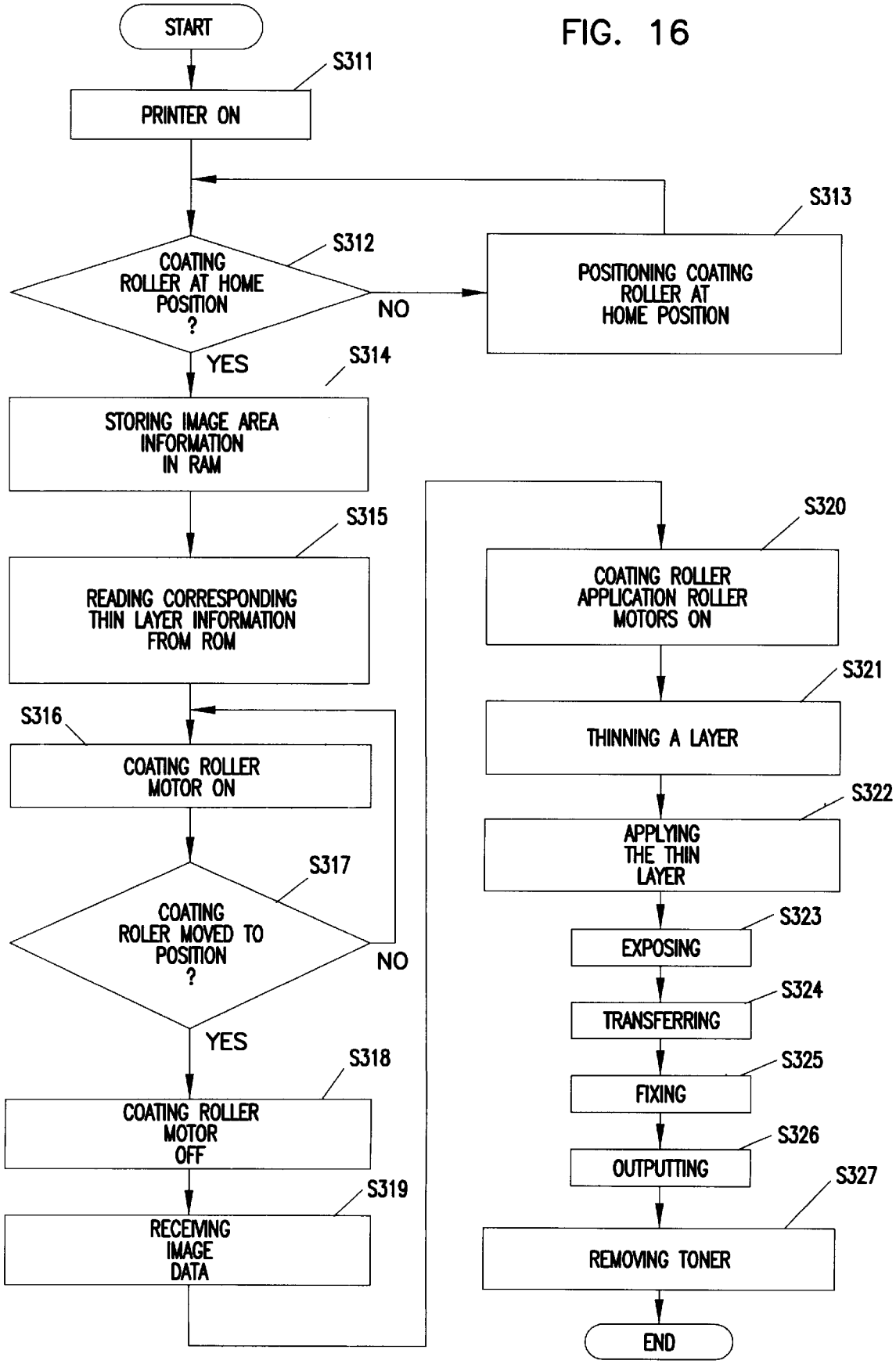
FIG. 16
START
S311
PRINTER ON
S312
COATING ROLLER AT HOME POSITION ?
NO
YES
S313
POSITIONING COATING ROLLER AT HOME POSITION
S314
STORING IMAGE AREA INFORMATION IN RAM
S315
READING CORRESPONDING THIN LAYER INFORMATION FROM ROM
S316
COATING ROLLER MOTOR ON
S317
COATING ROLER MOVED TO POSITION ?
NO
YES
S318
COATING ROLLER MOTOR OFF
S319
RECEIVING IMAGE DATA
S320
COATING ROLLER APPLICATION ROLLER MOTORS ON
S321
THINNING A LAYER
S322
APPLYING THE THIN LAYER
S323
EXPOSING
S324
TRANSFERRING
S325
FIXING
S326
OUTPUTTING
S327
REMOVING TONER
END

METHOD AND SYSTEM FOR SAVING TONER DEVELOPER IN IMAGE DUPLICATING DEVICES

FIELD OF THE INVENTION

The current invention is generally related to a method of and a system for controlling toner developer, and more particularly related to the method of and a system for conserving toner developer in an image-forming device.

BACKGROUND OF THE INVENTION

Japanese Patent Laid Publication Hei 7-209922 discloses an image-forming device using highly viscous and highly concentrated liquid toner developer. For example, FIG. 1 illustrates a liquid toner image-forming device in a block diagram. A feed roller 7 and a pair of register rollers 8 feed a piece of an image-carrying medium such as a sheet of paper into a liquid toner image-forming unit 4 from an image-carrying holding unit 5. The liquid toner image-forming unit 4 includes a photoreceptor drum 1 whose surface is first electrically uncharged by a charge removal unit 10, then cleaned by a cleaning unit 11 for removing residual electrical charge and toner, and electrically charged in a uniform manner by a charging unit 2. An exposing unit 3 generates an electrostatic image on the photoreceptor surface according to a desired image to be duplicated. The electrostatic image is then adjacently positioned to a developer belt 41 which carries a sheet of toner developer and is visualized by toner on the developer belt 41. In other words, toner is selectively transferred onto the photoreceptor surface according to the electrostatic image pattern. The visualized image on the photoreceptor 1 is further rotated towards a transfer roller 9 where the toner is transferred from the photoreceptor surface 1 to an image-carrying medium. A fixing unit 12 stabilizes the transferred toner image. The image-carrying medium with the duplicated image is placed in an output holding unit 13.

Still referring to FIG. 1, in order to prepare a uniformly thin layer of liquid toner developer 43, a series of rollers transfers the liquid toner developer 43 from a toner developer storage unit 44 onto the developer belt 41. The liquid toner developer 43 contains liquid toner as image-forming particles dispersed in insulating liquid developer such as methyl poly-siloxane oil and is highly viscous about 10000 mPa•s for visualizing the electrostatic image. An application roller 45 is partially submerged in the above described toner developer 43 and rotates in a counter clockwise direction. A squeeze roller 47 rotates together with the application roller 45 in a counter clockwise direction and abuts the application roller 45 to maintain a desired level of the liquid toner developer 43 on the application roller 45. A coating roller 46 is located above the squeeze roller 47 and abuts the application roller 45 while rotating also in the counter clock direction. Thus, a desirable level of the liquid toner developer 43 reaches the coating roller 46.

The developer belt 41 is supported by a plurality of rollers 41*a* through 41*d*. The developer belt 41 contacts the coating roller 46 at one end and is juxtaposed to the photoreceptor 1 at the other end. Thus, a layer of the liquid toner developer 43 is formed on the developer belt 41 and is juxtaposed to the photoreceptor drum 1 for selectively transferring a portion of the toner onto the photoreceptor surface according to the electrostatic image via a bias voltage exerted by a bias voltage unit 42 at the supporting roller 41*d*. On the other hand, the developer or the carrier from the liquid toner developer layer is uniformly transferred onto the photoreceptor surface. After the toner and developer transfer, a belt cleaning blade 48 removes residual liquid toner developer on the photoreceptor belt 41 and collects it in a used toner holding unit 49.

The above-described uniform thin layer of the liquid toner developer is fixedly predetermined regardless of the size of the image-carrying medium. For example, even if a post card is used to print image or text, the thin layer of the liquid toner developer is prepared in a larger size such as A4 size. In other words, since the same set of rollers including the application roller 45, the squeeze roller 47 and the coating roller 46 is utilized in preparing the thin layer of the liquid toner developer, the identically sized thin layer is generated regardless of the ultimate destination size of the image-carrying medium. When the size of the image-carrying medium is smaller than that of the identically sized thin layer, an unused portion of the liquid toner developer corresponding to an area outside the smaller image-carrying medium is wasted. The current invention is addressed at least to reduce the above-described waste of the toner developer.

SUMMARY OF THE INVENTION

In order to solve the above and other problems, according to a first aspect of the current invention, a method of saving developer in duplicating an image on an image-carrying medium, includes the acts of: determining a size of a developer application area; allocating an amount of the developer according to the size of the developer application area; and selectively transferring a portion of the allocated developer to the image-carrying medium based upon a desired image.

According to a second aspect of the current invention, n apparatus for saving developer in an image duplicating device, includes: a developer application area determination unit for determining a size of a developer application area; a developer allocation unit connected the developer application area determination unit for allocating an amount of the developer according to the size of the developer application area; and an image forming unit connected to the developer allocation unit for selectively transferring a portion of the allocated developer to an image-carrying medium based upon a desired image.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 10 is a flow chart illustrating acts involved in a third preferred process of generating a variable width of liquid toner developer according to the current invention.

FIG. 16 is a flow chart illustrating acts involved in a fifth preferred process of generating a variable width of liquid toner developer according to the current invention.

DETAILED DESCRIPTION OF THE PREFERRED EMBODIMENT(S)

Figure 1:
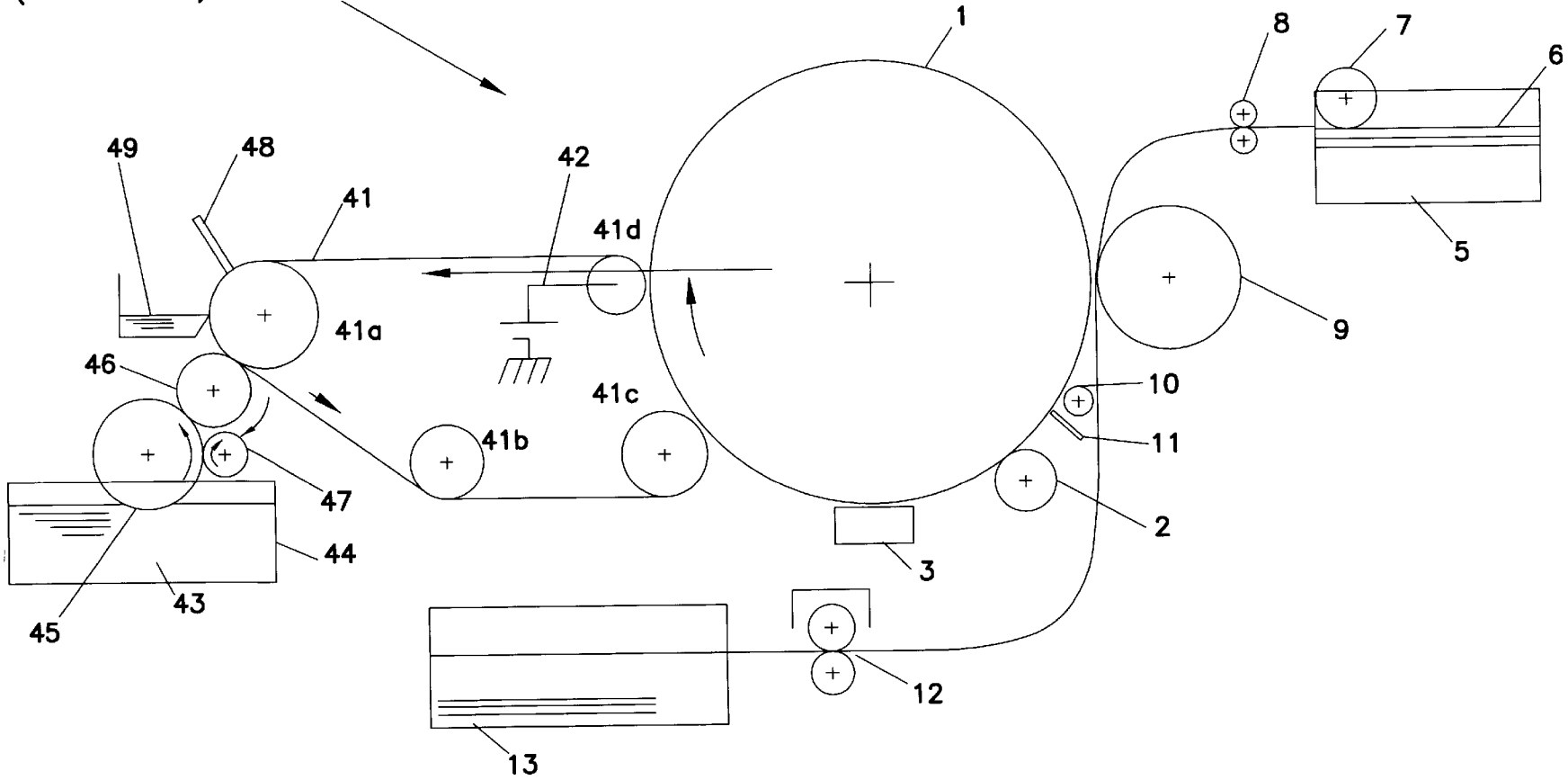
FIG. 1 ( PRIOR ART )
FIG. 1 illustrates a prior art liquid toner image-forming device in a block diagram.
Figure 2:
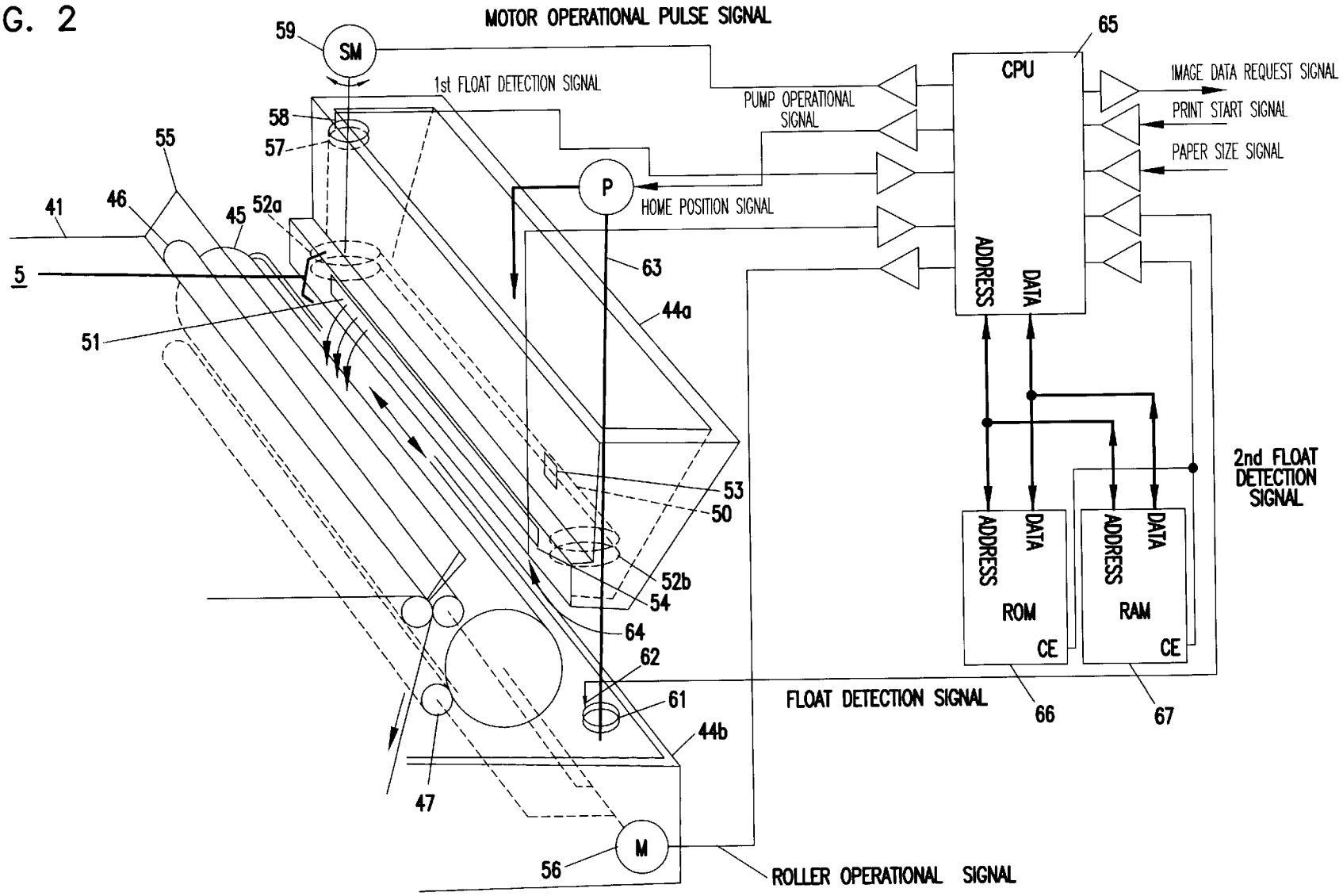
FIG. 2 illustrates a first preferred embodiment of the apparatus for saving toner developer according to the current invention.

Referring now to the drawings, wherein like reference numerals designate corresponding structure throughout the views, and referring in particular to FIG. 2, a first preferred embodiment of the apparatus for saving toner developer according to the current invention is illustrated in a perspective view as well as in a block diagram. The liquid toner developing device 4 includes a liquid toner developer holding unit 44*a* for holding the liquid toner developer, an adjustable release outlet 5 for controlling the size of the thin layer as well as a series of an application roller 45 and a coating roller 46 for transferring the variably sized thin layer to a developer belt 41. While these and other components are illustrated in a perspective view, a controlling unit is illustrated in a block diagram. The controlling unit includes a read-only memory (ROM) unit 66, a random access memory (RAM) unit 67 as well as a central processing (CPU) unit 65 for controlling the adjustable release outlet 5 as well as a pump 60 for recycling used liquid toner developer.

Still referring to FIG. 2, in order to control the size or the width of the thin layer, the adjustable release outlet 5 is located near the bottom surface of the liquid toner developer holding unit 44*a*. The adjustable release outlet 5 includes a timing belt 50 which loops around a pair of rotatable pulleys 52*a*, 52*b* located near each end of the bottom inner surface of the liquid toner developer holding unit 44*a*. The timing belt 50 further includes a liquid toner developer releasing portion 51 for allowing the liquid toner developer to be released from the liquid toner developer holding unit 44*a* onto the application roller 45. The liquid toner developer releasing portion 51 has equidistantly positioned bores. The timing belt 50 further includes a home position indicator portion 53 which is an optical reflector for reflecting a light when the timing belt 50 is positioned at a predetermined home position. A reflector wiper 54 is located along a course of the timing belt 50 and wipes the optical reflector surface 53 before the optical surface 53 reaches an optical sensor 64 for sensing the light reflected by the optical reflector 53. In order to position the timing belt 50 at a desired position so as to determine the width of the thin layer, the timing belt is initially positioned at a home position where no portion of the liquid toner developer releasing portion is exposed to the adjustable release outlet 5. To place the timing belt 50 at the home position, a pulley stepping motor 59 rotates the pulley 52*a*, and the home position sensor 64 detects the home position indicator portion 53. After the timing belt 50 is placed at the home position, the stepping motor 59 further rotates the pulley 52*a* so as to place the timing belt 50 at a position with respect to the home position for a desired width of the liquid toner developer releasing portion 51.

The released liquid toner developer is ultimately transferred onto a developer belt 41 to form a thin layer of the desired width. To start the transfer, the released liquid toner developer is initially applied onto an application roller 45 which is located near the adjustable release outlet 5. A squeeze roller 47 abuts the application roller 45 so as to remove an excess amount of the liquid toner developer from the application roller 45. In other words, the squeeze roller 47 controls an amount of the liquid toner developer on the application roller 45 for controlling a thickness of the layer to be formed on the developer belt 41. A coating roller 46 abuts the application roller 45 at one side and receives the liquid toner developer from the application roller 45. The coating roller 46 also abuts the developer belt 41 on the other side and transfers the liquid toner developer onto to the developer belt 41 so as to form a thin layer of the liquid toner developer of the desired width. A roller motor 56 rotates the application roller 45, the squeeze roller 47 and the coating roller 46. After the thin layer on the developer belt 41 is used for forming an image, a cleaning blade 55 removes residual liquid toner developer from the developer belt 41, and the removed liquid toner developer is stored in a liquid toner developer storage unit 44*b* for recycling. A recycling pump 60 pumps the stored liquid toner developer back into the toner developer holding unit 44*a* for reuse. A first float 57 indicates the level of available liquid toner developer in the liquid toner developer holding unit 44*a*, and a first float detector 58 detects a predetermined full level position when the available liquid toner developer reaches the full level. At the full level, the first float detector 58 generates a first float detection signal to stop the recycling pump 60. Similarly, a second float 61 indicates the level of stored liquid toner developer in the liquid toner developer storage unit 44*b*, and a second float detector 62 detects a predetermined level. When the second float detector 62 detects the stored liquid toner developer at the predetermined level, the second float detector 62 generates a second float detection signal.

Still referring to FIG. 2, some of the above described components are controlled by the CPU unit 65. In response to a print start signal and a paper size signal from a printer controller, the CPU unit 65 stores certain information of the print start signal and the paper size signal such as the paper size in the RAM unit 67 and retrieves from the ROM unit 66 information corresponding to the information stored in the RAM unit 67. Furthermore, the CPU unit 65 examines whether or not the first and second float detectors 58 and 62 have respectively generated the first and second float detection signals. The CPU unit 65 also examines whether or not the home position sensor 64 has generated a home position signal. Based upon the above input signals, the CPU unit 65 outputs a motor operational pulse signal to the pulley stepping motor 59 to position the timing belt 50 at a proper position. Based upon the above input signals the CPU unit 65 also outputs a pump operation signal to the recycling pump 60 as well as a roller operation signal to the roller motor 56. The CPU unit 65 controls the position of the timing belt 50 to determine the width of the thin layer of the liquid toner developer at the beginning of the print operation and does not allow the width change until the next print start signal is received.

Furthermore, the CPU unit 65 performs an automatic closing of the adjustable release outlet. When a malfunction such as paper jam occurs while the timing belt 50 is positioned to release liquid toner developer, the liquid toner developer is depleted from the liquid toner developer holding unit 44*a* and collected in the liquid toner developer storage unit 44*b*. The depletion of the liquid toner developer in the holding unit 44*a* requires the pump to transfer the liquid toner developer from the storage unit 44*b* to the holding unit 44*a* upon the recovery from the malfunction. To prevent the depletion, at the end of printing or at the onset of malfunction, the timing belt 50 is automatically positioned at a predetermined home position where no liquid toner developer is released from the liquid toner developer holding unit 44*a*. This automatic positioning allows the liquid toner developer holding unit 44*a* to always maintain a certain amount of liquid toner developer so that the image duplicating device immediately outputs a duplicated image without first pumping the liquid toner developer into the holding unit 44*a* after a malfunction or an accidental power loss. The automatic positioning also keeps track of a correct home position without relying upon the RAM unit 67.

Figure 3A:
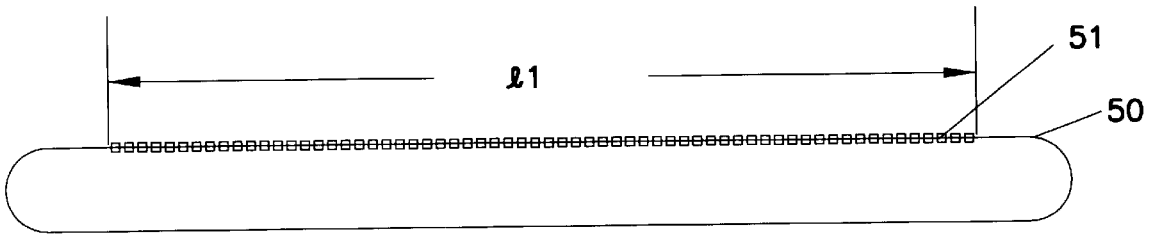
FIGS. 3A–C illustrate top-view block diagrams of a timing belt at three exemplary positions for forming three different sizes of a thin layer of liquid toner developer.
Figure 3B:
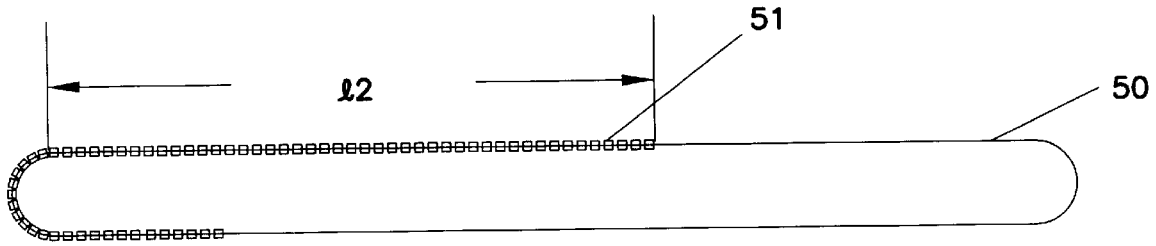
Figure 3C:
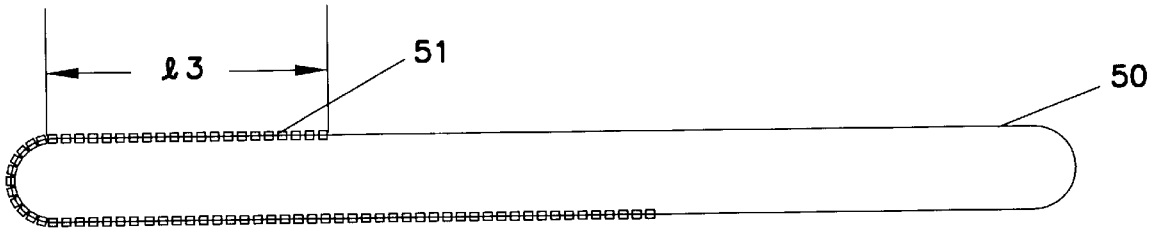

FIGS. 3A–C illustrate top-view block diagrams of a timing belt at three exemplary positions for forming three different sizes of a thin layer of liquid toner developer. FIG. 3A illustrates the width 11 which generates the widest thin layer by placing a release outlet portion 51 of the timing belt 50 at a position aligned with the outlet of the liquid toner developer holding unit 44*a*. FIG. 3B shows that the timing belt is positioned so that the width 12 of the release outlet portion 51 is exposed to the outlet portion of the liquid toner developer holding unit 44*a*. Lastly, FIG. 3C shows that the width L3 of the timing belt 50 generates the thin layer having the narrowest width 13. In place of the above described timing belt 50, in an alternative embodiment, the adjustable liquid toner developer outlet 5 can be implemented to adjust the size of the bore located at the bottom of the liquid toner developer holding unit 44*a*. In another alternative embodiment, in lieu of the optical home position detection unit, a home position of the timing belt 50 is detected by a mechanical detector.

Figure 4:
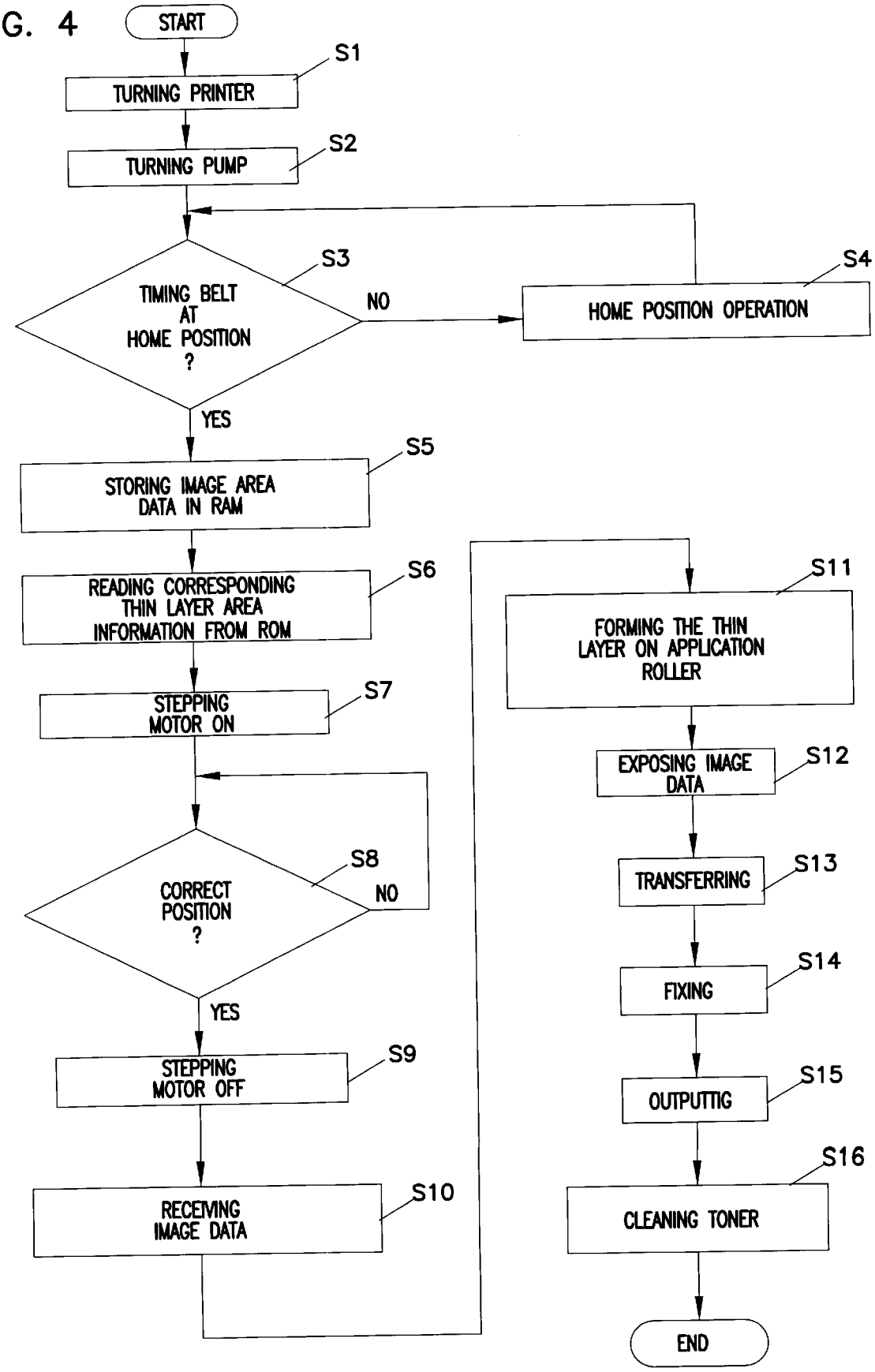
FIG. 4 is a flow chart illustrating acts of a first preferred process of controlling the size of a thin layer of liquid toner developer according to the current invention.

FIG. 4 is a flow chart illustrating acts of a first preferred process of controlling the size of a thin layer of liquid toner developer according to the current invention. Some of these acts are described in reference to components in FIG. 2. In actS1, an image duplicating device or a printer is turned on, and a pump 60 is also turned on in act S2. It is determined whether or not a timing belt 50 is at a predetermined home position in act S3. If the timing belt 50 is not at the home position, then the timing belt 50 is moved to the home position in act S4, and act S3 is repeated. On the other hand, when the timing belt 50 is already at the home position, a CPU unit 65 waits for a print start signal and an image area data signal. Upon receiving these signals, the CPU unit 65 stores information regarding the area of an image to be printed in a RAM unit 67 in act S5. In response to the above act S5, information regarding the thin layer corresponding to the image area is read from a ROM unit 66 in act S6. Based upon the above information, after a stepping motor 59 is activated in act S7, the stepping motor 59 adjustably places the timing belt 50 so as to position a release outlet portion 51 for generating the thin layer of liquid toner developer with a desired width or size in act 8. When the timing belt 50 is positioned at the desired location, the stepping motor 59 is turned off in act S9. At this time, the image data to be printed is received in response to an image data request signal. Liquid toner developer is released through the adjustably positioned release outlet 51 of the timing belt 50 onto an application roller 45 in act S11 so as to form a thin layer of the desired width. After the thin layer is formed, a photoreceptor is exposed to form a desired image pattern according to the image data in act S12. After a series of acts including transferring in act S13 and fixing in act S14 is completed for forming a desired image on an image-carrying medium such as paper, a duplicated image is then outputted in act S15. The residual toner developer is then removed from a developer belt 41 in act S16 for recycling.

Figure 5:
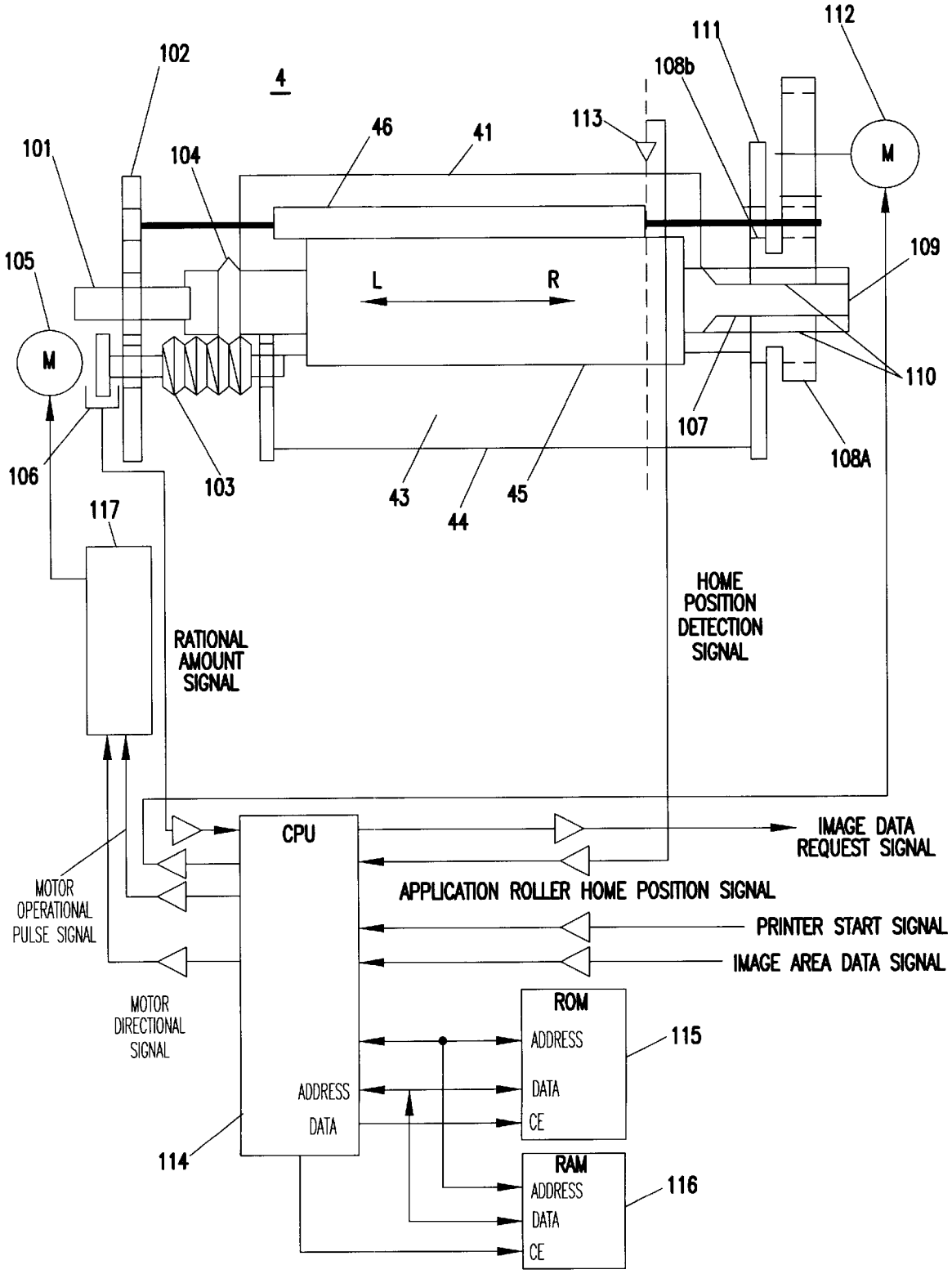
FIG. 5 illustrates a second preferred embodiment of the apparatus for adjusting the thin layer of liquid toner developer according to the current invention.

Referring to FIG. 5, a second preferred embodiment of the apparatus for adjusting the thin layer of liquid toner developer according to the current invention is illustrated in a top view as well as in a block diagram. In order to ultimately generate a variable width thin layer on a developer belt 41, a series of rollers are used to transfer the liquid toner developer from a liquid toner developer holding unit 44. An application roller 45 is partially submerged in liquid toner developer 43 held in the liquid toner developer holding unit 44, and the application roller 45 holds the liquid toner developer on its surface as it rotates. A coating roller 46 abuts the application roller 45 on one side and receives the liquid toner developer from the application roller 45. The coating roller 46 also abuts the developer belt 41 on the other side to transfer the liquid toner developer onto the developer belt 41. A pair of side plates 102 and 111 supports the application roller 45 and the coating roller 46 for their rotational movement. Near the right side plate 111, a roller motor 112 is located and rotates the coating roller 46 as well as the application roller 45 having a shaft 109 via a gear portion 108*a* whose shaft is supported by a gear shaft supporting portion 108*b*. The shaft 109 has a groove 107, and the gear portion 108*a* has a corresponding projection for engagement. The left side plate 102 supports a shaft 101 of the application roller 45, and the shaft 101 includes an engagement portion 104. A stepping motor 105 rotates a screw portion 103 which engages with the engagement portion 104 of the application roller shaft 104. As a result of the rotation of the screw portion 103, the application roller 45 is moved in a horizontal direction as indicated by an arrow L-R so as to change an overlapping width between the application roller 45 and the coating roller 46. This overlapping width determines the ultimate width of the thin layer of the liquid toner developer on the developer belt 41. A horizontal encoder 106 detects an amount of the horizontal movement of the application roller 45 and generates a rotational amount or horizontal movement signal. A home position sensor 113 detects a predetermined home position of the horizontally movable application roller 45 and generates a home position signal.

Still referring to FIG. 5, some of the above described components are controlled by a CPU unit 114. The CPU unit 114 examines whether or not the home position sensor 113 has generated a home position signal. If not, the CPU unit 114 sends a move-to-the-home position signal to a motor driver 117 to position the application roller 45 to the home position. The CPU unit 114 sends an image data request signal to a printer controller to initiate a printing process. In response to a printer start signal and an image area data or paper size signal from a printer controller, the CPU unit 114 stores certain information of the print start signal and the paper size signal such as the paper size in the RAM unit 116 and retrieves from the ROM unit 115 information corresponding to the information stored in the RAM unit 116. Based upon the above input signals, the CPU unit 114 outputs a motor operational pulse signal and the motor operational pulse signal to the motor driver 117 so as to position the application roller 45 at a desired position for generating a desired width of the thin layer of liquid toner developer. The horizontal encoder 106 monitors an amount of the actual horizontal movement and generates a horizontal movement signal for the CPU unit 114. Furthermore, the CPU unit 114 performs an automatic repositioning of the application roller 45 to a predetermined home position. This automatic repositioning allows the image duplicating device to maintain a correct home position after a malfunction or an accidental power loss without relying upon the RAM unit 116. In an alternative embodiment of the apparatus for adjusting the thin layer of liquid toner developer according to the current invention has a horizontally movable coating roller or a combination of horizontally movable application and coating rollers in order to variably adjust the width of the thin layer. Another alternative embodiment also has a solenoid for moving the application roller 45 in a horizontal direction in lieu of the stepping motor 105, the screw portion 103 and the engagement portion 104.

Figure 6:
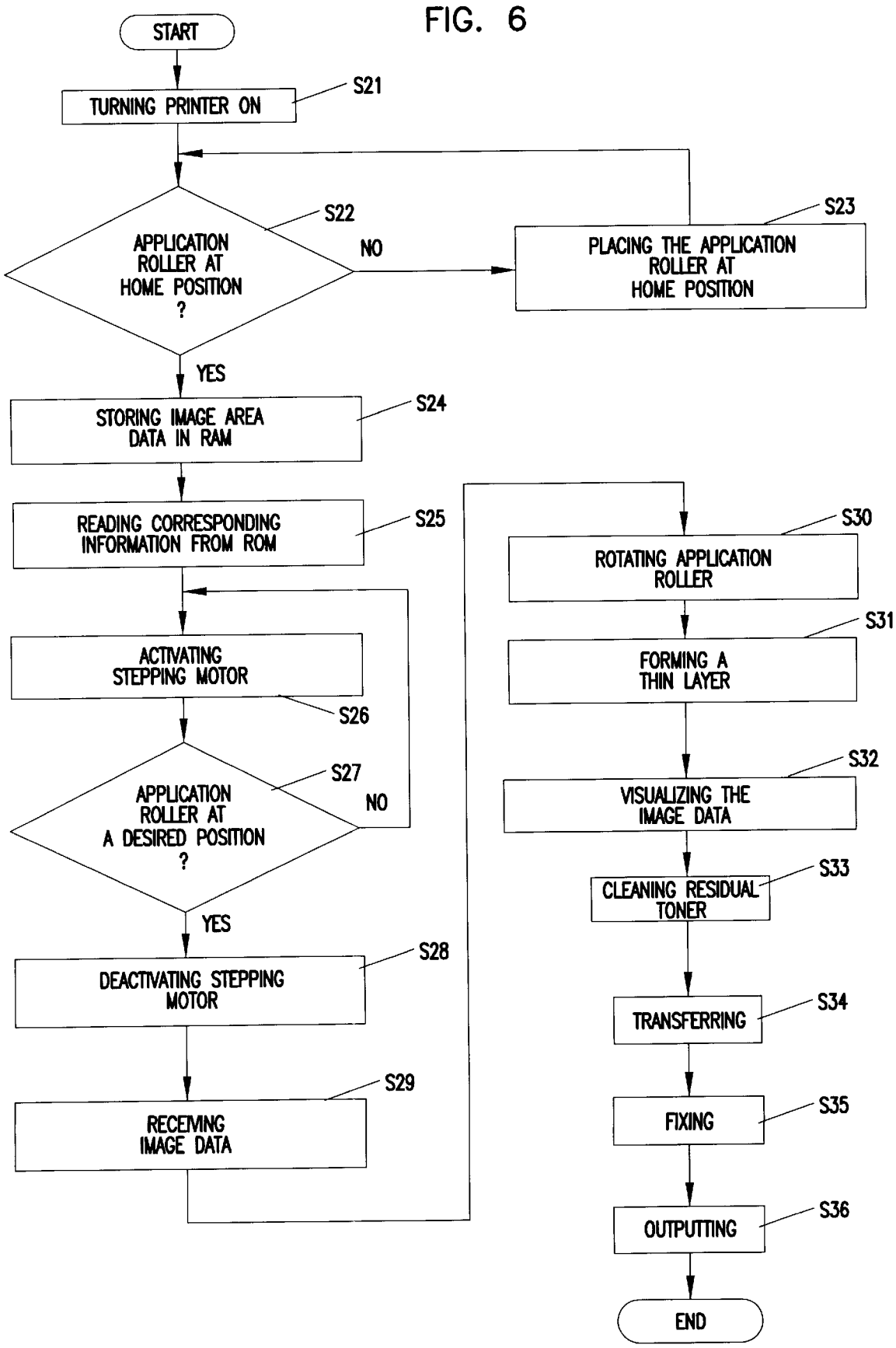
FIG. 6 is a flow chart illustrating acts of a second preferred process of adjusting the thin layer of liquid toner developer according to the current invention.

FIG. 6 is a flow chart illustrating acts of a second preferred process of adjusting the thin layer of liquid toner developer according to the current invention. Some of these acts are described in reference to components in FIG. 5. In act S21, an image duplicating device or a printer is turned on. It is determined whether or not an application roller 45 is at a predetermined home position in act S22. If the application roller 45 is not at the home position, then the application roller 45 is moved to the home position in act S23, and the act S22 is repeated. On the other hand, when the application roller 45 is already at the home position, a CPU unit 114 waits for a print start signal and an image area data signal. Upon receiving these signals, the CPU unit 114 stores information regarding the area of an image to be printed in a RAM unit 116 in act S24. In response to the above act S24, information regarding the thin layer corresponding to the image area is read from a ROM unit 115 in act S25. Based upon the above information, after a stepping motor 105 is activated in act S26, the stepping motor 106 adjustably places the application roller 45 at an overlapping position with a coating roller 46 for generating the thin layer of liquid toner developer of a desired width in act S27. When the application roller 45 is positioned at the desired location, the stepping motor 105 is turned off in act S28. At this time, the image data to be printed is received in response to an image data request signal. An application roller 45 is rotated by a motor 112 in act S30 so as to form a thin layer of the desired width. After the thin layer is formed on the application roller 45, it is transferred onto a developer belt 41 via a coating roller 46 in act S31. A photoreceptor is exposed to form a desired image pattern using toner in the liquid toner developer according to the image data in act S32. The residual toner developer is then removed from the developer belt 41 in act S33. After a series of acts including transferring of the toner in act S34 and fixing in act S35 is completed for forming a desired image on an image-carrying medium such as paper, a duplicated image is then outputted in act S36.

Figure 7:
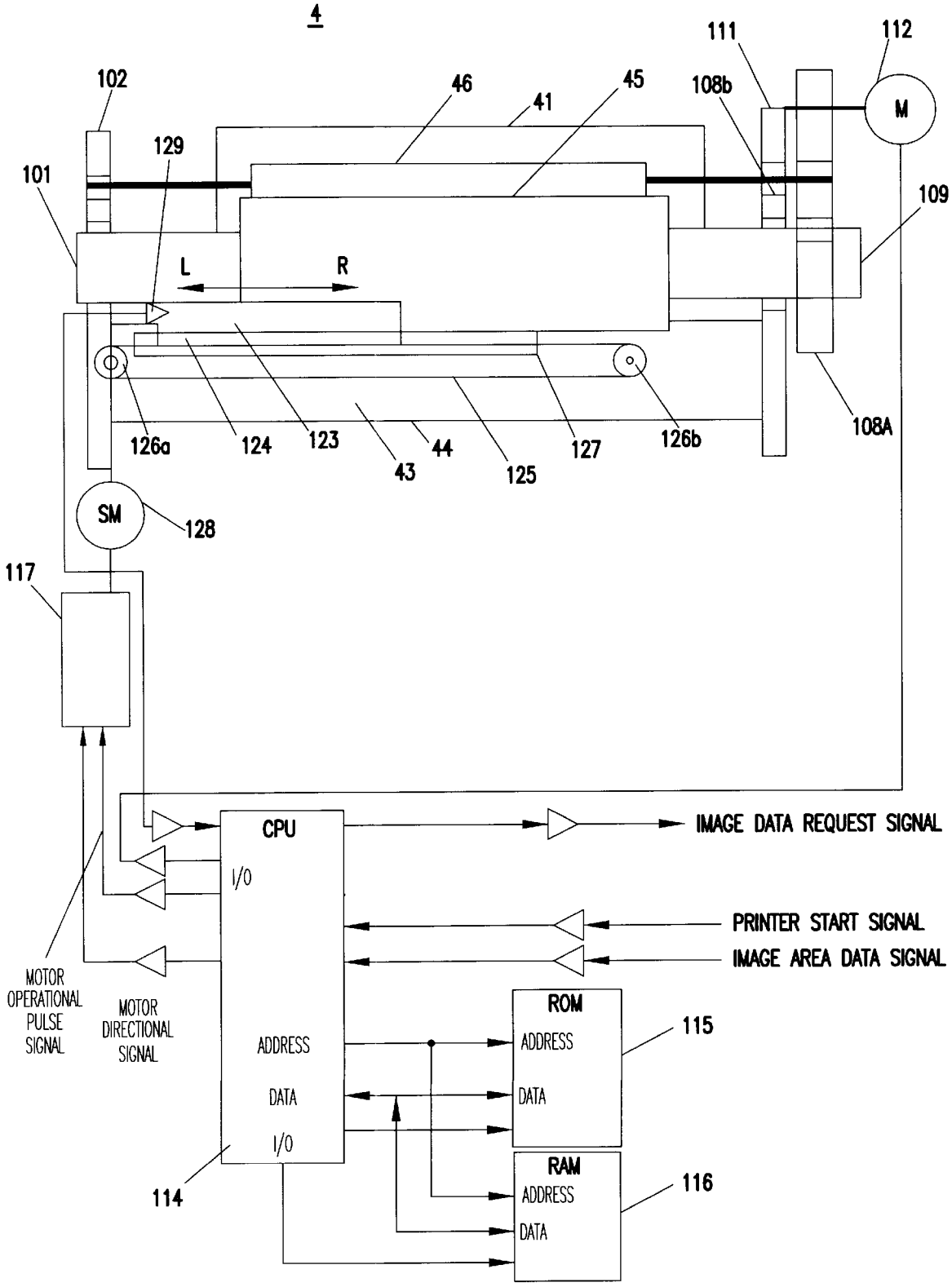
FIG. 7 illustrates a third preferred embodiment of the apparatus for adjusting the thin layer of liquid toner developer according to the current invention.

Now referring to FIG. 7, a third preferred embodiment of the apparatus for adjusting the thin layer of liquid toner developer according to the current invention is illustrated in a top view as well as in a block diagram. In order to ultimately generate a variable width thin layer on a developer belt 41, a series of rollers are used to transfer the liquid toner developer from a liquid toner developer holding unit 44. An application roller 45 is partially submerged in liquid toner developer 43 held in the liquid toner developer holding unit 44, and the application roller 45 holds the liquid toner developer on its surface as it rotates. A coating roller 46 abuts the application roller 45 on one side and receives the liquid toner developer from the application roller 45. The coating roller 46 also abuts the developer belt 41 on the other side to transfer the liquid toner developer onto the developer belt 41. A pair of side plates 102 and 111 supports the application roller 45 and the coating roller 46 for their rotational movement. Near the right side plate 111, a roller motor 112 is located and rotates the coating roller 46 as well as the application roller 45 having a shaft 109 via a gear portion 108*a* whose shaft is supported by a gear shaft supporting portion 108*b*. The left side plate 102 supports a shaft 101 of the application roller 45. A pair of pulleys 126*a* and 126*b* is located near the application roller 45, and a timing belt 125 loops around the pair of the pulleys 126*a* and 126*b*. The timing belt 125 further includes a cleaning blade 123 which is attached to the timing belt 125 via a blade attachment portion 124 and a timing belt guide portion 127. A stepping motor 128 rotates the pulley 126*a* in response to a stepping motor signal from a motor driver 117. As a result of the pulley rotation, the timing belt places the cleaning blade at a desired position with respect to the application roller 45. When the cleaning blade 123 is placed over the application roller 45 in an overlapping manner, the cleaning blade 123 abuts the application roller 45. The cleaning blade 123 squeezes the liquid toner developer out from an area where the cleaning blade 123 overlaps the application roller 45 and generates a desired width of the liquid toner developer on the application roller 45. A home position sensor 129 sensors a predetermined home position of the cleaning blade 123 with respect to the application roller 45.

Still referring to FIG. 7, some of the above described components are controlled by a CPU unit 114. The CPU unit 114 examines whether or not the home position sensor 113 has generated a home position signal. If not, the CPU unit 114 sends a move-to-the-home position signal to a motor driver 117 to position the cleaning blade 123 to the home position. The CPU unit 114 sends an image data request signal to a printer controller to initiate a printing process. In response to a printer start signal and an image area data or paper size signal from a printer controller, the CPU unit 114 stores certain information of the print start signal and the paper size signal such as the paper size in the RAM unit 116 and retrieves from the ROM unit 115 information corresponding to the information stored in the RAM unit 116. Based upon the above input signals, the CPU unit 114 outputs a motor operational pulse signal and the motor operational pulse signal to the motor driver 117 so as to position the cleaning blade 123 at a desired position for ultimately generating a desired width of the thin layer of liquid toner developer. Furthermore, the CPU unit 114 performs an automatic repositioning of the cleaning blade 123 to a predetermined home position. This automatic repositioning allows the image duplicating device to maintain a correct home position after a malfunction or an accidental power loss without relying upon the RAM unit 116.

Figure 8:
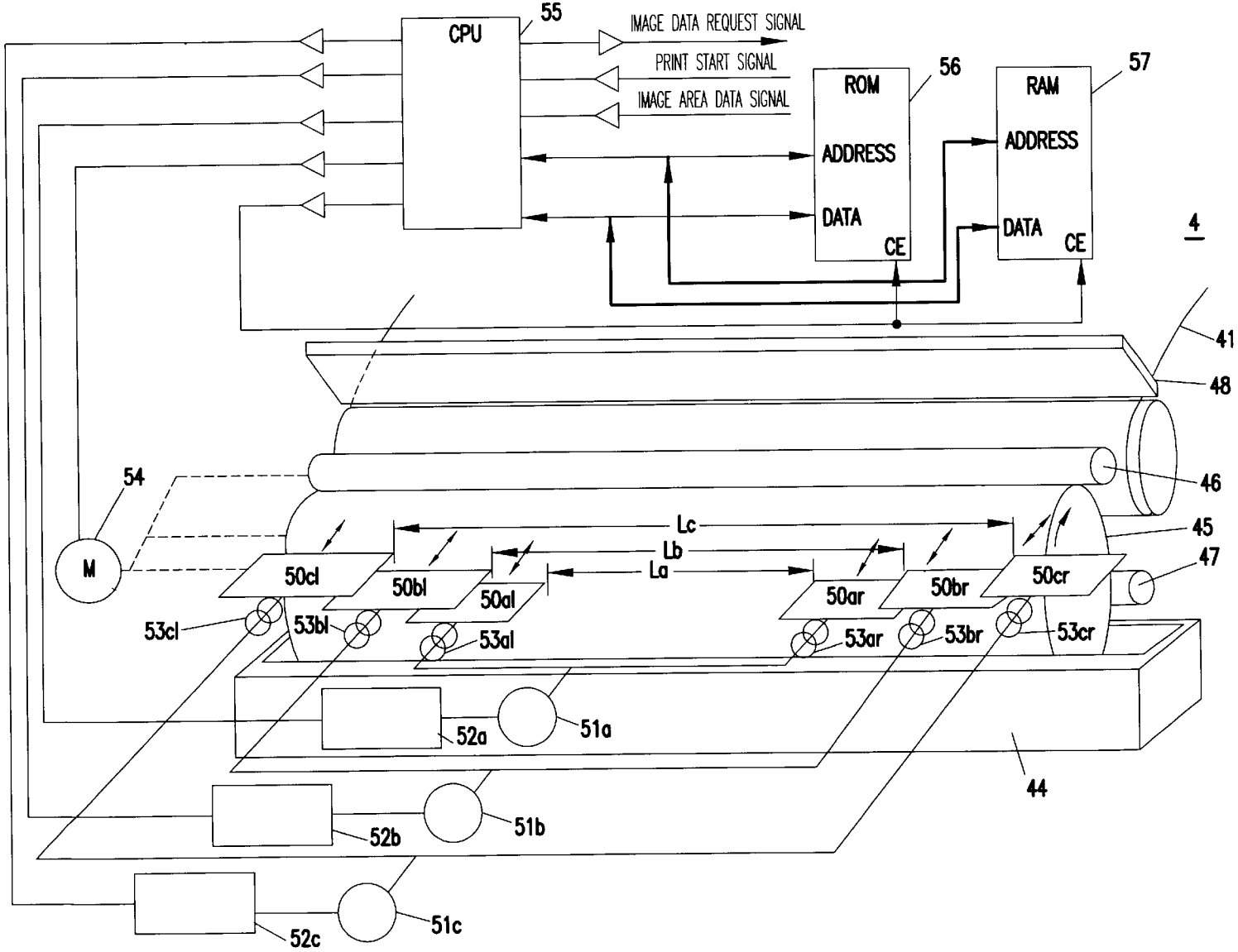
FIG. 8 illustrates a fourth preferred embodiment of the apparatus for adjusting the thin layer of liquid toner developer according to the current invention.

Now referring to FIG. 8, a fourth preferred embodiment of the apparatus for adjusting the thin layer of liquid toner developer according to the current invention is illustrated in a perspective view as well as in a block diagram. In order to ultimately generate a variable width thin layer on a developer belt 41, a series of rollers are used to transfer the liquid toner developer from a liquid toner developer holding unit 44. An application roller 45 is partially submerged in liquid toner developer held in the liquid toner developer holding unit 44, and the application roller 45 holds the liquid toner developer on its surface as it rotates. A squeeze roller 47 abuts the application roller 45 and squeezes a certain amount of the liquid toner developer from the application roller 45 to maintain a constant level of the liquid toner developer on the application roller 45. A coating roller 46 abuts the application roller 45 on one side and receives the liquid toner developer from the application roller 45. The coating roller 46 also abuts the developer belt 41 on the other side to transfer the liquid toner developer onto the developer belt 41. A rotation motor 54 rotates the application roller 45, the coating roller 46 and the squeeze roller 47. A cleaning blade 48 removes residual liquid toner developer on the developer belt 41 after processing.

In order to adjust the width of the thin layer to be generated on the developer belt 41, pairs of cleaning blades 50*ar*, 50*al*, 50*br*, 50*bl* and 50*cr*, 50*cl* are placed near the application roller 45 and perpendicular to a rotational surface of the application roller 45. Each of solenoids 51*a*, 51*b* and 51*c* is independently activated to position a corresponding pair of the cleaning blades 50*ar*, 50*al*, 50*br*, 50*bl* and 50*cr*, 50*cl* as indicated by arrows via a respective pair of solenoid drivers 52*a*, 52*b* and 52*c* to abut the application roller 45 against force exerted by a corresponding pair of the bias springs 53*ar*, 53*al*, 53*br*, 53*bl* and 53*cr*, 53*cl*. As a result of the independently positioned cleaning blades, a desired width of the liquid toner developer is obtained on the application roller 45. To illustrate the variable width using the above described cleaning blades 50*ar*, 50*al*, 50*br*, 50*bl* and 50*cr*, 50*cl*, three widths La, Lb and Lc are considered. To obtain the width La of the liquid toner developer on the application roller 45, all of the cleaning blades 50*ar*, 50*al*, 50*br*, 50*bl* and 50*cr*, 50*cl* are placed against the application roller 45. Similarly, to obtain the width Lb, the cleaning blades 50*br*, 50*bl* and 50*cr*, 50*cl* are placed against the application roller 45. Lastly, to obtain the width Lc, the cleaning blades 50*cr* and 50*cl* only are placed against the application roller 45.

Still referring to FIG. 8, some of the above described components are controlled by a CPU unit 55. The CPU unit 55 sends an image data request signal to a printer controller to initiate a printing process. In response to a printer start signal and an image area data or paper size signal from a printer controller, the CPU unit 55 stores certain information of the print start signal and the paper size signal such as the paper size in the RAM unit 57 and retrieves from the ROM unit 56 information corresponding to the information stored in the RAM unit 57. Based upon the above input signals, the CPU unit 55 outputs an individual solenoid activation signal to the solenoid drivers 52*a*, 52*b* and 52*c* so as to position the cleaning blades 50*ar*, 50*al*, 50*br*, 50*bl* and 50*cr*, 50*cl* at a desired position for ultimately generating a desired width of the thin layer of liquid toner developer. Furthermore, the CPU unit 55 performs an automatic repositioning of the cleaning blades 50*ar*, 50*al*, 50*br*, 50*bl* and 50*cr*, 50*cl* to a predetermined home position. This automatic repositioning allows the image duplicating device to maintain a correct home position of the cleaning blades after a malfunction or an accidental power loss without relying upon the RAM unit 57.

Figure 9A:
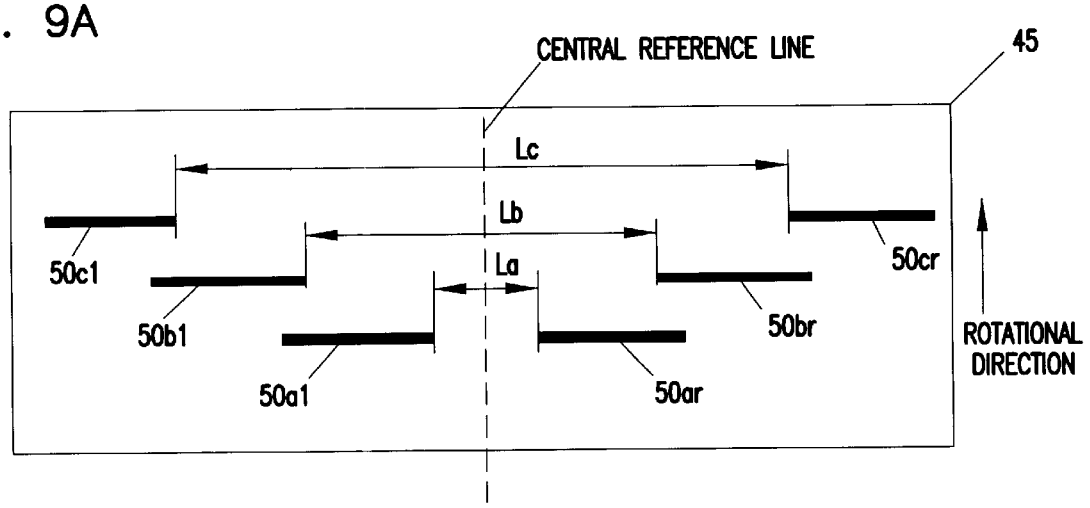
FIGS. 9A, 9B and 9C illustrate three exemplary pairs of cleaning blades according to the current invention.
Figure 9B:
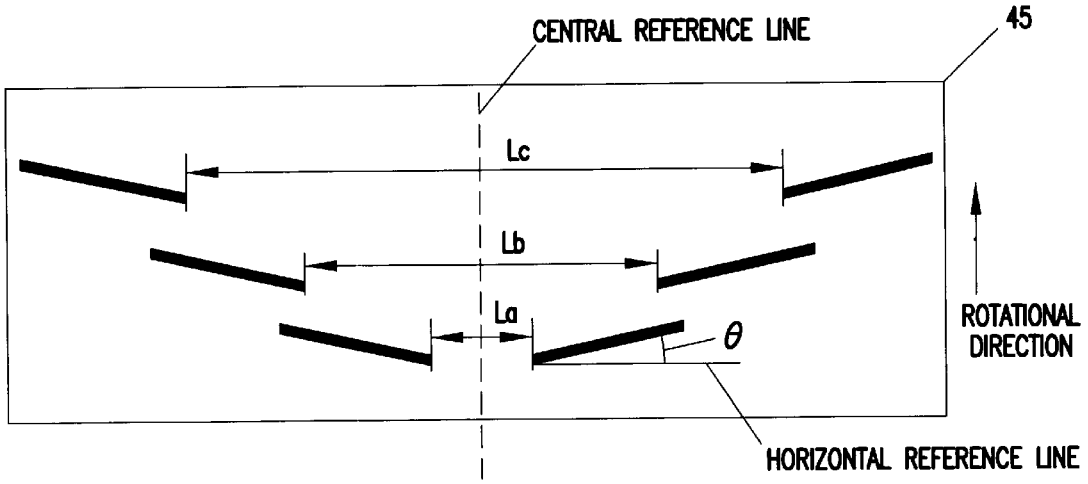
Figure 9C:
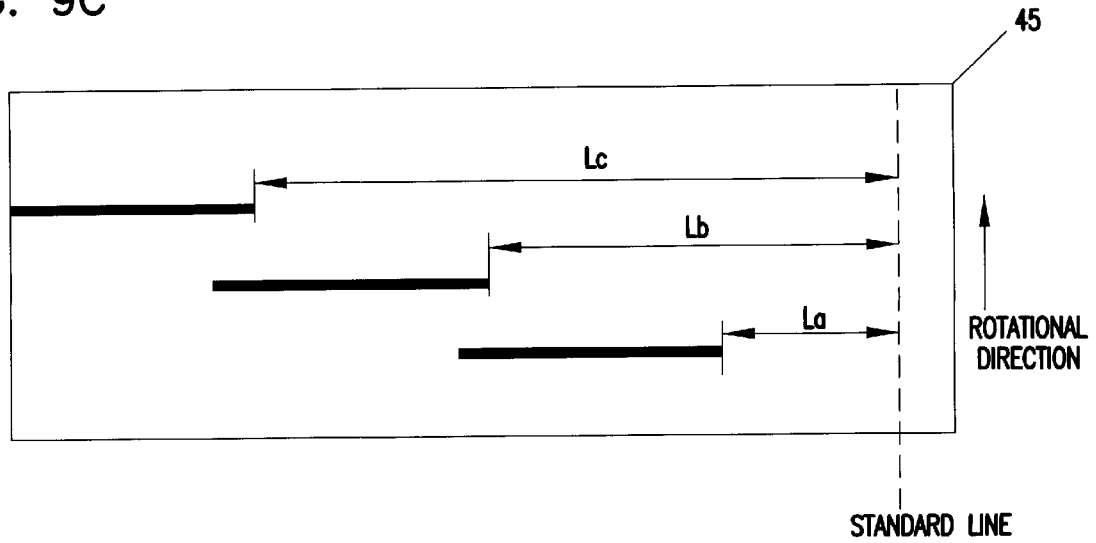

FIGS. 9A, 9B and 9C illustrate three exemplary pairs of cleaning blades. FIG. 9A is a side view illustrating three pairs of cleaning blades 50*ar*, 50*al*, 50*br*, 50*bl* and 50*cr*, 50*cl* and an application roller 45. The application roller 45 rotates in a direction as indicated by an arrow, and the three pairs of cleaning blades 50*ar*, 50*al*, 50*br*, 50*bl* and 50*cr*, 50*cl* are placed symmetrically about a central reference line. On each side of the application roller 45 has three cleaning blades, and an adjacent pair of the cleaning blades is partially overlapping in a horizontal direction. FIG. 9B illustrates another exemplary arrangement of the cleaning blades in a side view. About a central reference line, each pair of cleaning blades is symmetrically placed, and each cleaning blade is also placed at a predetermined angle θ with respect to a horizontal reference line or the rotational axis of the application roller 45. An adjacent pair of the cleaning blades is partially overlapping in the horizontal direction. Lastly, FIG. 9C illustrates yet another exemplary arrangement of the cleaning blades in a side view. Three cleaning blades are placed with respect to a reference line which is hypothetically located near one end of the application roller 45. A first cleaning blade is positioned at a distance Lc away from the reference line. A second cleaning blade is positioned at a distance Lb away from the reference line. A third cleaning blade is positioned at a distance La away from the reference line. To generate three widths La, Lb and Lc of the liquid toner developer on the application roller 45 using these three cleaning blade arrangements, the above described principle with respect to FIG. 8 is applicable.

Now referring to FIG. 10, a flow chart illustrates acts involved in a third preferred process of generating a variable width of liquid toner developer according to the current invention. Some of these acts are described in reference to components in FIG. 8. As soon as an image duplicating device is turned on in act S100, all of solenoids 51*a*, 51*b* and 51*c* are deactivated for variably positioning the cleaning blades 50*ar*, 50*al*, 50*br*, 50*b1* and 50*cr*, 50*cl* at a predetermined home position in act S112. At this predetermined home position, the cleaning blades 50*ar*, 50*al*, 50*br*, 50*bl* and 50*cr*, 50*cl* are now not in contact with an application controller 45. The image device now waits for a printer start signal and an image area size signal from a printer controller. Upon receiving the above signals, a CPU unit 55 temporarily stores the image area data in a RAM unit 57 in act S113. The CPU unit 55 then retrieve from a ROM unit 56 information related to form a thin layer corresponding to the stored image area data in act S114. Based upon the retrieved information, solenoids 51*a*, 51*b* and 51*c* are selectively activated to position certain cleaning blades in contact with the application roller 45 in act S115. After the CPU unit 55 sends an image data request signal, the image data is received in act S116. At this time, a roller rotational motor 54 is activated in act S117. As a result of the cleaning blade placement in the act S115, the application roller 45, a coating roller 46 and a squeeze roller 47 are rotated to generate a thin layer of liquid toner developer of a desired width in act S118, and the thin layer is transferred onto a developer belt 41 in act S119. The CPU unit 55 forms an electrostatic image on a photoreceptor according to the image data, and the electrostatic image is visualized using the thin layer of the liquid toner developer on the developer belt 41 in act S120. The visualized image is now transferred onto an image-carrying medium in act S122 while the transferred image is fixed in act S122. The fixed image-carrying medium is outputted in act S123. Lastly, residual toner developer on the development belt 41 is removed by a cleaning blade 48 for recycling in act S124.

Figure 11:
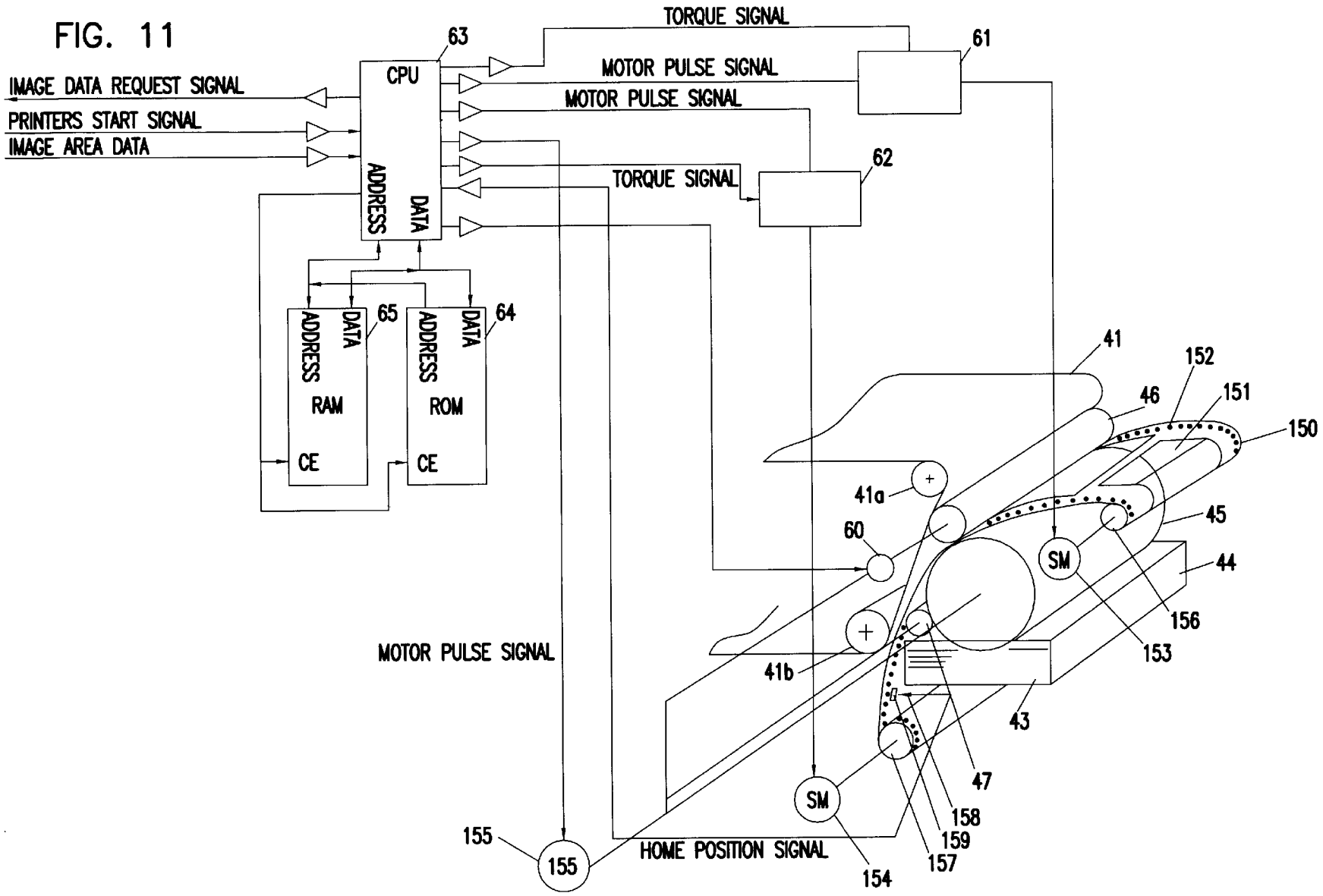
FIG. 11 illustrates a fifth preferred embodiment of the apparatus for adjusting the thin layer of liquid toner developer according to the current invention.

Now referring to FIG. 11, a fifth preferred embodiment of the apparatus for adjusting the thin layer of liquid toner developer according to the current invention is illustrated in a perspective view as well as in a block diagram. In order to ultimately generate a variable width thin layer on a developer belt 41, a series of rollers are used to transfer the liquid toner developer from a liquid toner developer holding unit 44. An application roller 45 is partially submerged in liquid toner developer 43 held in the liquid toner developer holding unit 44, and the application roller 45 holds the liquid toner developer 43 on its surface as it rotates. A squeeze roller 47 abuts the application roller 45 and squeezes a certain amount of the liquid toner developer from the application roller 45 to maintain a constant level of the liquid toner developer on the application roller 45. A coating roller 46 abuts the application roller 45 on one side and receives the liquid toner developer from the application roller 45. The coating roller 46 also abuts the developer belt 41 on the other side to transfer the liquid toner developer onto the developer belt 41. A rotation motor 115 rotates the application roller 45, the coating roller 46 and the squeeze roller 47.

In order to adjust the width of the thin layer to be generated on the developer belt 41, a mask belt or sheet 150 is placed between the application roller 45 and the coating roller 46. The mask belt 150 has a predetermined set of toner developer areas 151 where the liquid toner developer is transferred from the application roller 45 to the coating roller 46, and each end of the mask belt 150 is scrolled by a first scroll roller 156 and a second scroll roller 157. A first stepping motor 153 and a second stepping motor 154 respectively rotate the first and second scroll rollers 156 and 157 via a first driver 61 and a second driver 62 for positioning the mask belt 150 at a desired position with respect to the application roller 45 and the coating roller 46. The mask belt 150 further includes belt transfer holes 152 that are located near each edge of the mask belt 150 and engage with corresponding projections on the scroll rollers 156 and 157 for moving the mask belt 150 in a precise manner. In an alternative embodiment, a mask belt looped around the two rollers with a single stepping motor rather than scrolled on each end. In another alternative embodiment, the mask belt is located between a developer belt and a coating roller rather than between an application roller and the coating roller.

Still referring to FIG. 11, some of the above described components are controlled by a CPU unit 63. The CPU unit 63 sends an image data request signal to a printer controller to initiate a printing process. In response to a printer start signal and an image area data or paper size signal from a printer controller, the CPU unit 63 stores certain information of the print start signal and the paper size signal such as the paper size in the RAM unit 65 and retrieves from the ROM unit 64 information corresponding to the information stored in the RAM unit 65. Initially, the CPU unit 63 determines whether or not the mask belt 150 is at a predetermined home position with respect to the application roller 45 and the coating roller 46 based upon a home position signal. A home position detector 158 is an optical detector and generates the home position signal upon detecting light reflected by an optical reflector 157 on the mask belt 150. Based upon the above input signals, the CPU unit 63 outputs a pair of a torque signal and a motor pulse signal to the first driver 61 and the second driver 62 for moving a selected portion of the toner developer areas of the mask belt 150 as the application roller 45 and the coating roller 46 rotate for ultimately generating a desired width of the thin layer of liquid toner developer. The two scroll rollers 156 and 157 are both preferably rotated during the move to provide a desired amount of tension on the mask belt 151. Furthermore, the CPU unit 63 performs an automatic repositioning of the mask belt 150 to a predetermined home position. This automatic repositioning allows the image duplicating device to maintain a correct home position of the mask belt 150 after a malfunction or an accidental power loss without relying upon the RAM unit 65.

Figure 12:
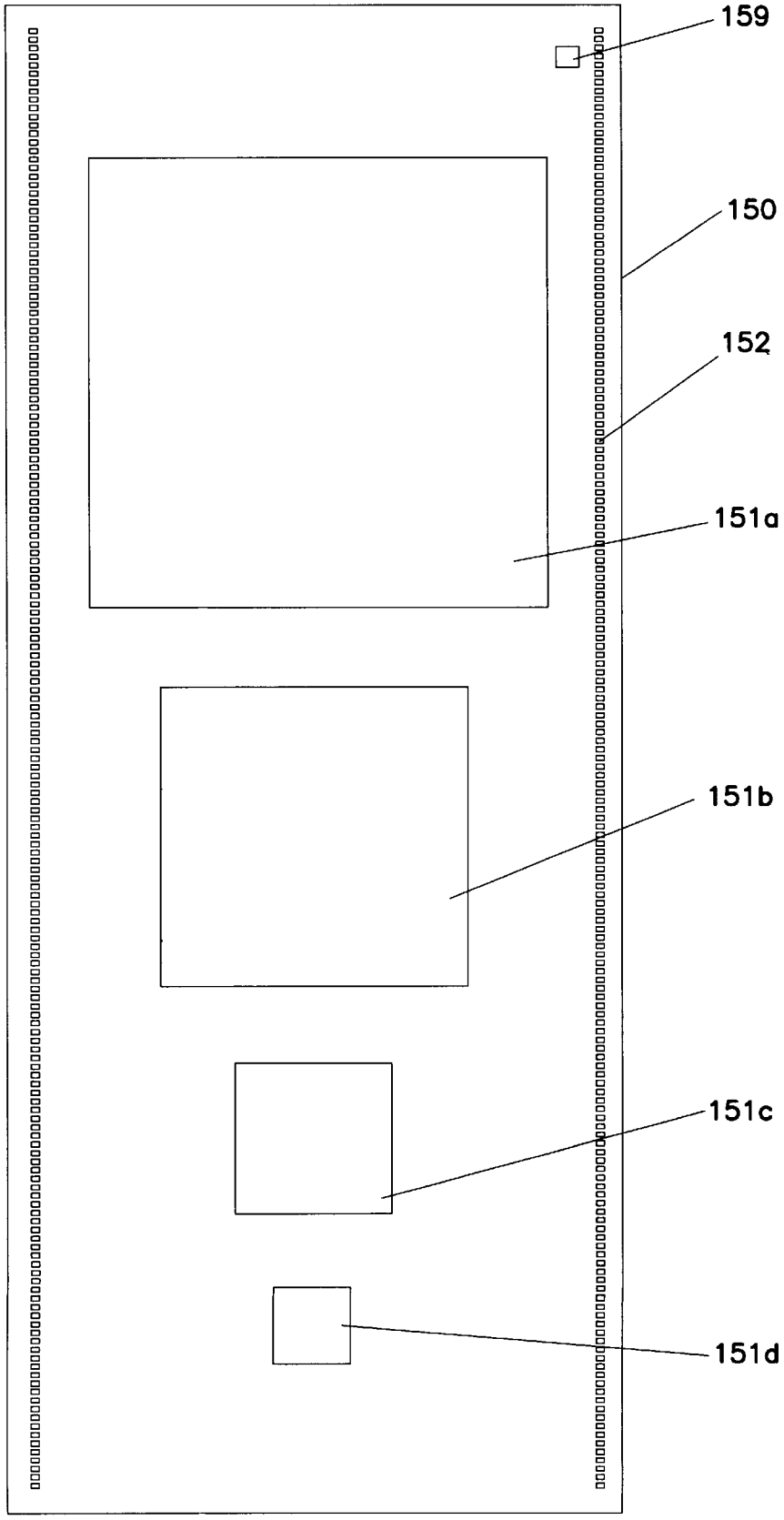
FIG. 12 illustrates one exemplary mask belt according to the current invention.

Now referring to FIG. 12, one exemplary mask belt 150 is illustrated in a top view after the mask belt 150 is unrolled from the rollers. This exemplary mask belt 150 includes a home position reflector 159, belt transfer holes 152 and four toner developer areas 151*a*, 151*b*, 151*c* and 151*d*. The toner developer area 151*a* generates a thin layer in the largest size while the toner developer area 151*d* generates the smallest size. After one of these toner developer areas 151*a*–151*d* is selected for generating a desired thin layer, the mask belt 151 is initially rolled or moved to a position where one end of the selected toner developer area is near an application roller and a coating roller. Then, as the application roller and the coating roller rotate together, the mask belt 150 is also moved or rolled via the belt transfer holes 152 so as to expose the entire length of the selected toner developer area to the application roller and the coating roller in a moving direction.

Figure 13:
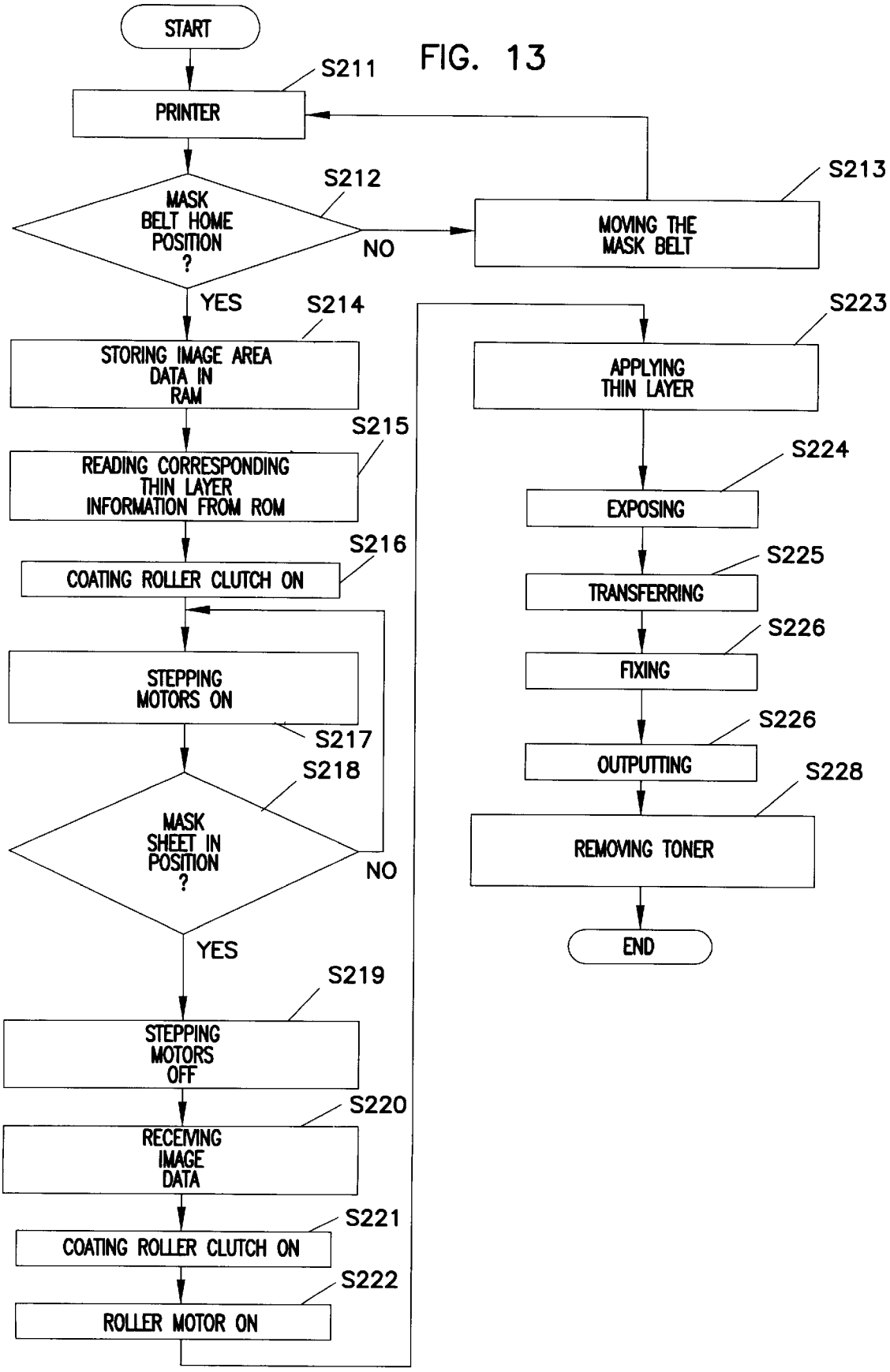
FIG. 13 is a flow chart illustrating acts involved in a fourth preferred process of generating a variable width of liquid toner developer according to the current invention.

Now referring to FIG. 13, a flow chart illustrates acts involved in a fourth preferred process of generating a variable width of liquid toner developer according to the current invention. Some of these acts are described in reference to components in FIG. 11. In act S211, an image duplicating device or a printer is turned on. It is determined whether or not a mask belt 150 is at a predetermined home position in act S212. If the mask belt 150 is not at the home position, then the mask belt 150 is moved to the home position in act S213, and the act S212 is repeated. On the other hand, when the mask belt 150 is already at the home position, a CPU unit 63 waits for a print start signal and an image area data signal. Upon receiving these signals, the CPU unit 63 stores information regarding the area of an image to be printed in a RAM unit 65 in act S214. In response to the above act S214, information regarding the thin layer corresponding to the image area is read from a ROM unit 64 in act S215. A coating roller 46 is disengaged from a rotation motor 155 by deactivating a clutch 60 in act S216 so that the mask belt 150 moves without restriction from the coating roller 46. Then, based upon the above information, scroll roller rotation motors 153 and 154 are activated in act S217 for moving the mask belt 150 to a selected portion for generating the thin layer of liquid toner developer of a desired width in act S217. When the mask belt 150 is positioned at the desired location in act S218, the stepping motors 153 and 154 are turned off in act S219. At this time, the image data to be printed is received in response to an image data request signal in act S220. After the coating roller 46 is engaged to rotate with the rotation motor 155 by activating the clutch 60 in act S221, the rotation motor 155 rotates the application roller 45, the coating roller 46 and the squeeze roller 47 while the mask belt 151 is advanced with a certain amount of tension exerted by the stepping motors 153 and 154. Depending upon the direction of movement, one of the stepping motors 153 and 154 is activated to advance the mask belt 150 while the other stepping motor is deactivated but maintaining a certain amount of torque to provide tension to the mask belt 150. A thin layer of the desired width is thus formed in act S223. A photoreceptor is exposed to form a desired image pattern according to the image data in act S224. After a series of acts including transferring of the toner in act S225 and fixing in act S226 is completed for forming a desired image on an image-carrying medium such as paper, a duplicated image is then outputted in act S227. The residual toner developer is then removed from the developer belt 41 in act S228.

Figure 14:
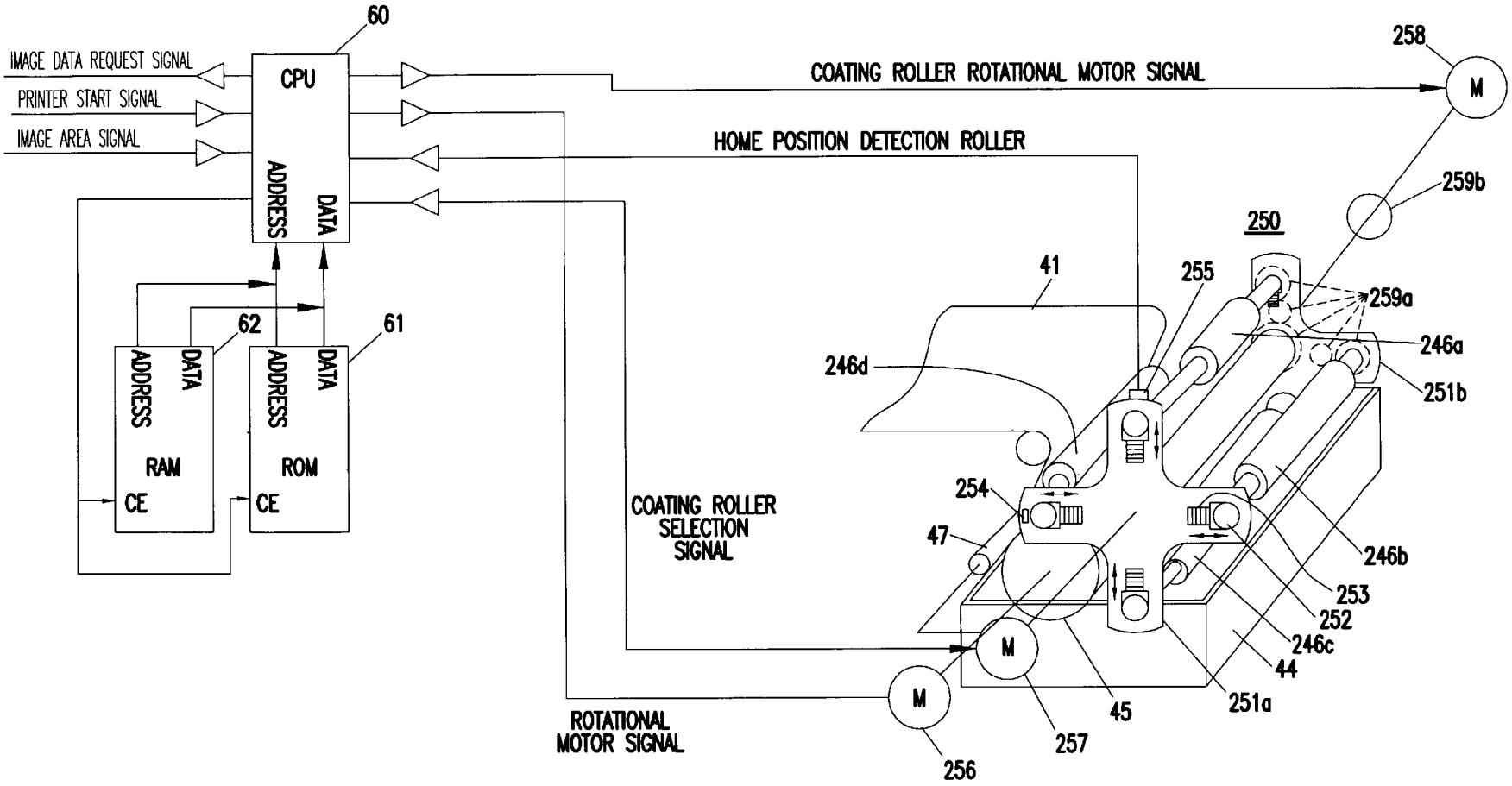
FIG. 14 illustrates a sixth preferred embodiment of the apparatus for adjusting the thin layer of liquid toner developer according to the current invention.

Now referring to FIG. 14, a sixth preferred embodiment of the apparatus for adjusting the thin layer of liquid toner developer according to the current invention is illustrated in a perspective view as well as in a block diagram. In order to ultimately generate a variable width thin layer on a developer belt 41, a series of rollers are used to transfer the liquid toner developer from a liquid toner developer holding unit 44. An application roller 45 is partially submerged in liquid toner developer 43 held in the liquid toner developer holding unit 44, and the application roller 45 holds the liquid toner developer 43 on its surface as it rotates. A squeeze roller 47 abuts the application roller 45 and squeezes a certain amount of the liquid toner developer from the application roller 45 to maintain a constant level of the liquid toner developer on the application roller 45. A set of coating rollers 246*a*, 246*b*, 246*c* and 246*d* is located near the application roller 45, and a selected one 246*d* of the coating rollers abuts the application roller 45 on one side and receives the liquid toner developer from the application roller 45. The selected coating roller 246*d* also abuts the developer belt 41 on the other side to transfer the liquid toner developer onto the developer belt 41. A rotation motor 256 rotates the application roller 45 and the squeeze roller 47.

In order to adjust the width of the thin layer to be generated on the developer belt 41, a selectable coating roller revolver 250 is placed near the application roller 45 and the coating roller 46. The coating roller revolver 250 has a predetermined set of coating rollers 246*a*, 246*b*, 246*c* and 246*d* with a different width and is rotatable to place one of the coating rollers 246*a*, 246*b*, 246*c* and 246*d* between the application roller 45 and the developer belt 41. The coating roller revolver 250 has a pair of a first side plate 251*a* and a second side plate 251*b* for resiliently holding the shafts of the four coating rollers 246*a*, 246*b*, 246*c* and 246*d*. Each of the shafts is held by a shaft holder 252 and a bias spring 253. A revolver rotational motor 257 rotates the coating roller revolver 250 to place one of the coating rollers 246*a*, 246*b*, 246*c* and 246*d* between the application roller 45 and the developer belt 41. A coating roller rotational motor 258 rotates the selected one of the coating rollers 246*a*, 246*b*, 246*c* and 246*d*, which is placed between the application roller 45 and the developer belt 41 and whose rotational clutch is activated. Other coating rollers are not rotated since their corresponding clutches 259*a* are not activated for engaging with the coating roller rotational motor 258. A home position sensor 255 determines a predetermined home position of the coating roller revolver 250 by detecting a position of a home position marker opening 254.

Still referring to FIG. 14, some of the above described components are controlled by a CPU unit 60. The CPU unit 60 sends an image data request signal to a printer controller to initiate a printing process. In response to a printer start signal and an image area data or paper size signal from a printer controller, the CPU unit 60 stores certain information of the print start signal and the paper size signal such as the paper size in the RAM unit 62 and retrieves from the ROM unit 61 information corresponding to the information stored in the RAM unit 62. Initially, the CPU unit 60 determines whether or not the coating roller revolver 250 is at a predetermined home position with respect to the application roller 45 and the developer belt 41 based upon a home position signal from the home position sensor 255. Based upon the above input signals, the CPU unit 60 outputs a coating roller selection signal to the revolver rotational motor 257 for rotating the coating roller revolver 250 to position a selected coating roller between the application roller 45 and the developer belt 41 for ultimately generating a desired width of the thin layer of liquid toner developer. Subsequently, the CPU unit 60 sends a rotational motor signal and a coating roller rotational motor signal to respectively activates the rotational motor 256 as well as the coating roller rotational motor 258. Furthermore, the CPU unit 60 performs an automatic repositioning of the coating roller revolver 250 to a predetermined home position. This automatic repositioning allows the image duplicating device to maintain a correct home position of the coating roller revolver 250 after a malfunction or an accidental power loss without relying upon the RAM unit 62.

Figure 15:
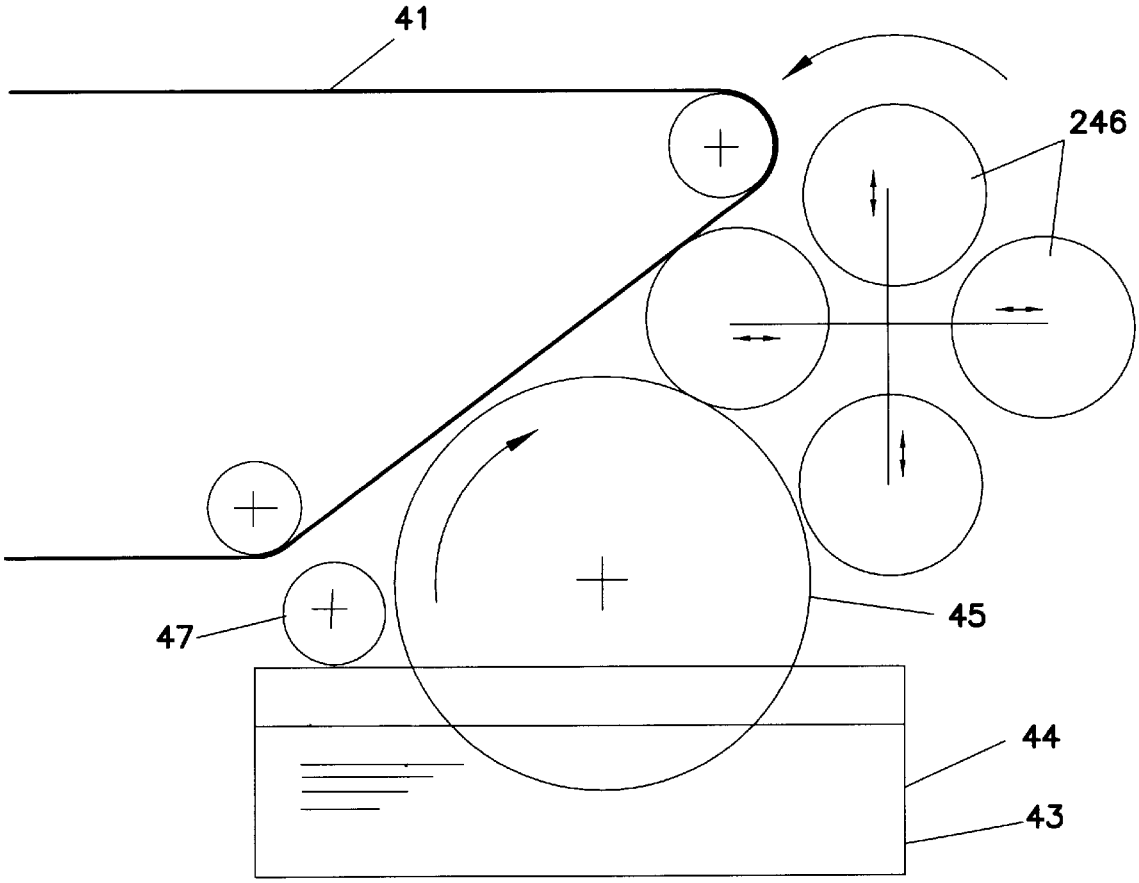
FIG. 15 illustrates a cross sectional view of components of the sixth preferred embodiment of transferring and forming a thin layer of the liquid toner developer with a variable width according to the current invention.

FIG. 15 illustrates a cross sectional view of components of the sixth preferred embodiment of transferring and forming a thin layer of the liquid toner developer with a variable width according to the current invention. An application roller 45 is partially submerged in liquid toner developer 43 held in a liquid toner developer holding unit 44, and the application roller 45 holds the liquid toner developer 43 on its surface as it rotates. A squeeze roller 47 abuts the application roller 45 and squeezes a certain amount of the liquid toner developer from the application roller 45 to maintain a constant level of the liquid toner developer on the application roller 45. A set of coating rollers 246 is located near the application roller 45 and a developer belt 41, and a selected one of the coating rollers 246 is placed between the application roller 45 and the developer belt 41 as the coating rollers 246 is rotated as a unit as indicated by a curved arrow. Each of the coating rollers 246 is resiliently held in a predetermined position with each other, and each coating roller 246 is allowed to move within in the unit as indicated by a strait arrow. The selected coating roller 246 abuts the application roller 45 and receives the liquid toner developer from the application roller 45. The selected coating roller 246*d* also abuts the developer belt 41 on the other side to transfer the liquid toner developer onto the developer belt 41.

Now referring to FIG. 16, a flow chart illustrates acts involved in a fifth preferred process of generating a variable width of liquid toner developer according to the current invention. Some of these acts are described in reference to components in FIG. 14. In act S311, an image duplicating device or a printer is turned on. It is determined whether or not a coating roller revolver 250 is at a predetermined home position in act S312. If the coating roller revolver 250 is not at the home position, then the coating roller revolver 250 is moved to the home position in act S313, and the act S312 is repeated. On the other hand, when the coating roller revolver 250 is already at the home position, a CPU unit 60 waits for a print start signal and an image area data signal. Upon receiving these signals, the CPU unit 60 stores information regarding the area of an image to be printed in a RAM unit 62 in act S314. In response to the above act S314, information regarding the thin layer corresponding to the image area is read from a ROM unit 61 in act S315. A revolver rotational motor 257 is activated to rotate the coating roller revolver 250 in act S316 until one of the coating rollers is selectively positioned between an application roller 45 and a developer belt 41 in act S317. The selected coating roller determines a desired width of the thin layer of the liquid toner developer. When a selected coating roller reaches the desired position in act S317, the revolver rotational motor 257 is deactivated in act S318. In response to an image data request signal, the CPU unit 60 receives image data in act S319. A rotation motor 256 and a coating roller rotational motor 258 rotate the selected coating roller, the application roller 45 and the squeeze roller 47 in act S320. A thin layer is formed on the application roller 45 by the squeeze roller 47 in act S321. The thin layer is transferred by the selected coating roller with a desired width in S322. A photoreceptor is exposed to form a desired image pattern according to the image data in act S323. After a series of acts including transferring of the toner in act S324 and fixing in act S325 is completed for forming a desired image on an image-carrying medium such as paper, a duplicated image is then outputted in act S326. The residual toner developer is then removed from the developer belt 41 in act S227.

Figure 17:
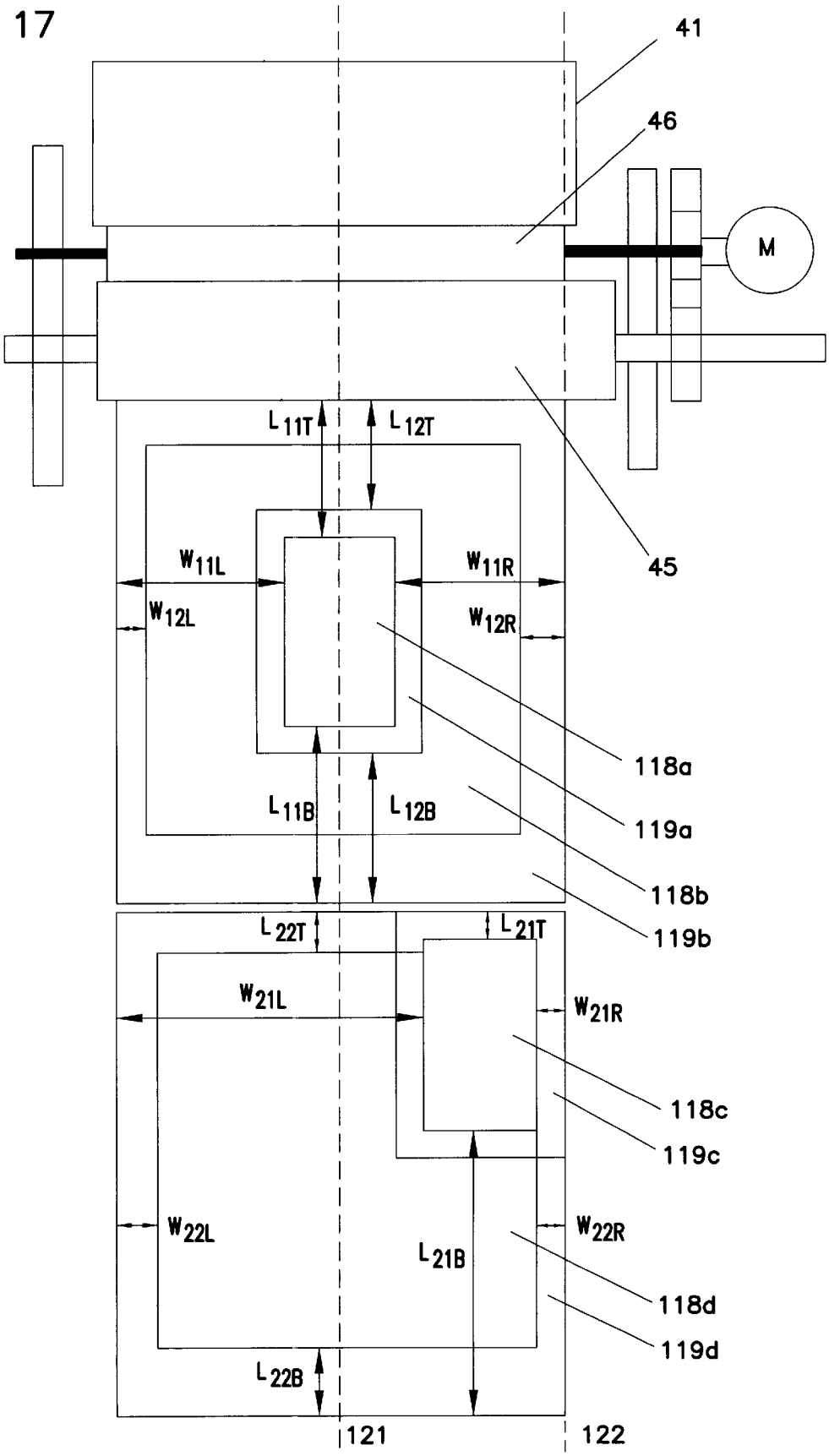
FIG. 17 is a diagram illustrating different sizes and positions of the thin layer of liquid toner developer according to the size and position of an image-carrying medium.

Now referring to FIG. 17, a diagram illustrates different sizes and positions of the thin layer of liquid toner developer according to the size and position of an image-carrying medium. For example, when a first image-carrying medium 119*a* has its image area 118*a* and is symmetrically positioned along a hypothetical reference central line 121, an excess area is defined to be an area outside the image area 118*a*. In this first example, liquid toner developer at least over an area having a width $W_{11R}$, $W_{11L}$ is saved by not initially applying or removing after initial application. Similarly, additional liquid toner developer over an area having length $L_{11}T$, $L_{11B}$ is also optionally saved. When a larger second image-carrying medium 119*b* has its image area 118*b* and is symmetrically positioned along a hypothetical reference central line 121, an excess area is defined to be an area outside the image area 118*b*. In this second example, liquid toner developer at least over an area having a width $W_{12R}$, $W_{12L}$ is saved by not initially applying or removing after initial application. Similarly, additional liquid toner developer over an area having length $L_{12T}$, $L_{12B}$ is also optionally saved.

Still referring to FIG. 17, the diagram illustrates additional examples of different sizes and positions of the thin layer of liquid toner developer. For example, when a third image-carrying medium 119*c* has its image area 118*c* and is positioned at the upper right corner, an excess area is defined to be an area outside the image area 119*c*. In this third example, liquid toner developer at least over an area having a width $W_{21R}$, $W_{21L}$ is saved by not initially applying or removing after initial application. Similarly, additional liquid toner developer over an area having length $L_{21T}$, $L_{21B}$ is also optionally saved. When a larger second image-carrying medium 119*d* has its image area 118*d* and is non-symmetrically positioned along a hypothetical reference central line 121, an excess area is defined to be an area outside the image area 118*d*. In this fourth example, liquid toner developer at least over an area having a width $W_{22R}$, $W_{22L}$ is saved by not initially applying or removing after initial application. Similarly, additional liquid toner developer over an area having length $L_{22T}$, $L_{22B}$ is also optionally saved. In generating any of the above four exemplary thin layer of the liquid toner developer, the above described methods and processes according to the current invention are used.

It is to be understood, however, that even though numerous characteristics and advantages of the present invention have been set forth in the foregoing description, together with details of the structure and function of the invention, the disclosure is illustrative only, and that although changes may be made in detail, especially in matters of shape, size and arrangement of parts, as well as implementation in software, hardware, or a combination of both, the changes are within the principles of the invention to the full extent indicated by the broad general meaning of the terms in which the appended claims are expressed.

What is claimed is:

1. A method of saving developer in duplicating an image on an image-carrying medium, comprising the acts of:

determining a size of a developer application area;

allocating an amount of the developer according to the size of the developer application area by applying the developer to a first intermediate unit according to a predetermined area and resizing an area of the applied developer on the first intermediate unit according to the size of the developer application area; and selectively transferring a portion of the allocated developer to the image-carrying medium based upon a desired image.

2. The method of saving developer according to claim 1 wherein the developer is liquid toner.

3. The method of saving developer according to claim 1 wherein the size of the developer application area is determined based upon a size of the image-carrying medium.

4. The method of saving developer according to claim 1 wherein the size of the developer application area is rectangular.

5. The method of saving developer according to claim 4 wherein the act of allocating the amount of the developer is limited by adjusting a width of the developer application area.

6. The method of saving developer according to claim 4 wherein the act of allocating the amount of the developer is limited by adjusting a length of the developer application area.

7. The method of saving developer according to claim 1 further comprising an additional act of coating a second intermediate unit with the resized area of the applied developer.

8. An apparatus for saving developer in an image duplicating device, comprising:

a developer application area determination unit for determining a size of a developer application area;

a developer allocation unit connected the developer application area determination unit for allocating an amount of the developer according to the size of the developer application area;

the developer allocation unit further comprising:

a developer storage unit for storing the developer; and a developer application control unit connected to the developer storage unit for allocating the amount of the developer from the developer storage unit, the amount being dependent upon the size of the developer application area;

an image forming unit connected to the developer allocation unit for selectively transferring a portion of the allocated developer to an image-carrying medium based upon a desired image wherein the developer application control unit further includes:

an application roller for receiving the developer; and an adjustable developer release outlet for adjusting an outlet size for varying the amount of the developer to be released from the developer storage unit onto the application roller.

9. An apparatus for saving developer in an image duplicating device, comprising:

a developer application area determination unit for determining a size of a developer application area;

a developer allocation unit connected the developer application area determination unit for allocating an amount of the developer according to the size of the developer application area;

the developer allocation unit further comprising:

a developer storage unit for storing the developer; and a developer application control unit connected to the developer storage unit for allocating the amount of the developer from the developer storage unit, the amount being dependent upon the size of the developer application area;

an image forming unit connected to the developer allocation unit for selectively transferring a portion of the allocated developer to an image-carrying medium based upon a desired image wherein the developer application control unit further includes:

an application roller being horizontally movable and partially submerged in the developer in the developer storage for temporarily holding the developer; and a coating roller located at a fixed position with respect to the application roller, the coating roller being at least partially overlapping with and being in contact with the application roller for receiving the developer from the application roller, the amount of the received developer being dependent upon an amount of the overlap between the coating roller and the application roller.

10. An apparatus for saving developer in an image duplicating device, comprising:

a developer application area determination unit for determining a size of a developer application area;

a developer allocation unit connected the developer application area determination unit for allocating an amount of the developer according to the size of the developer application area;

the developer allocation unit further comprising:

a developer storage unit for storing the developer; and a developer application control unit connected to the developer storage unit for allocating the amount of the developer from the developer storage unit, the amount being dependent upon the size of the developer application area;

an image forming unit connected to the developer allocation unit for selectively transferring a portion of the allocated developer to an image-carrying medium based upon a desired image wherein the developer application control unit further includes:

an application roller partially submerged in the developer in the developer storage for temporarily holding the developer; and a set of selectable masks located over the application roller, each of the masks having a predetermined size of permeable area for the developer, a mask being selected based upon the size of the developer application area.

11. An apparatus for saving developer in an image duplicating device, comprising:

a developer application area determination unit for determining a size of a developer application area;

a developer allocation unit connected the developer application area determination unit for allocating an amount of the developer according to the size of the developer application area;

the developer allocation unit further comprising:

a developer storage unit for storing the developer; and a developer application control unit connected to the developer storage unit for allocating the amount of the developer from the developer storage unit, the amount being dependent upon the size of the developer application area;

an image forming unit connected to the developer allocation unit for selectively transferring a portion of the allocated developer to an image-carrying medium based upon a desired image wherein the developer application control unit further includes:

an application roller partially submerged in the developer in the developer storage for temporarily holding the developer; and a set of selectable coating rollers located near the application roller, each of the coating rollers having a predetermined size, one of the coating rollers being selected based upon the size of the developer application area and being placed in contact with the application roller for receiving the developer from the application roller.

* * * * *